US011325389B2

(12) United States Patent
Koase et al.

(10) Patent No.: US 11,325,389 B2
(45) Date of Patent: May 10, 2022

(54) LIQUID EJECTING APPARATUS

(71) Applicant: SEIKO EPSON CORPORATION, Tokyo (JP)

(72) Inventors: Takashi Koase, Shiojiri (JP); Yuta Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 17/003,002

(22) Filed: Aug. 26, 2020

(65) Prior Publication Data

US 2021/0060966 A1 Mar. 4, 2021

(30) Foreign Application Priority Data

Aug. 29, 2019 (JP) ..... JP2019-156434

(51) Int. Cl.
*B41J 2/175* (2006.01)

(52) U.S. Cl.
CPC ..... *B41J 2/17563* (2013.01)

(58) Field of Classification Search
CPC .... B41J 2/17563; B41J 2/175; B41J 2/17509; B41J 2/17513; B41J 29/13; B41J 29/02; B41J 2/01; B41J 2/17503
USPC ..... 347/93
See application file for complete search history.

(56) References Cited

U.S. PATENT DOCUMENTS

2005/0068391 A1* 3/2005 Inoue ..... B41J 2/1752 347/86

FOREIGN PATENT DOCUMENTS

JP 2011-240706 A 12/2011
JP 2015-139919 A 8/2015

* cited by examiner

*Primary Examiner* — Kristal Feggins
*Assistant Examiner* — Alexander D Shenderov
(74) *Attorney, Agent, or Firm* — Workman Nydegger

(57) ABSTRACT

A liquid ejecting apparatus including a liquid ejecting head that ejects a liquid, a liquid storage portion that stores the liquid, a supply flow path that communicates the liquid ejecting head and the liquid storage portion with each other, and an air chamber that is coupled to the supply flow path through a plurality of flow paths. The supply flow path includes a filter. The plurality of flow paths are, in the supply flow path, connected upstream of the filter, and the air chamber is positioned at a position higher than the filter when in a posture during use.

11 Claims, 16 Drawing Sheets

LIQUID EJECTING APPARATUS

The present application is based on, and claims priority from JP Application Serial Number 2019-156434, filed Aug. 29, 2019, the disclosure of which is hereby incorporated by reference herein in its entirety.

BACKGROUND

1. Technical Field

The present disclosure relates to a liquid ejecting apparatus such as a printer.

2. Related Art

JP-A-2011-240706 discloses an ink jet printer that performs printing by ejecting a liquid such as ink and the like supplied from a liquid container on a medium such as a sheet of paper and the like through a recording head serving as an example of a liquid ejecting head.

In liquid ejecting apparatuses such as ink jet printers and the like, there are cases in which the liquid ejecting apparatus is conveyed and the like while a liquid such as ink or the like is still contained in the liquid container. While conveying the liquid ejecting apparatus, there are cases in which the liquid ejecting apparatus is disposed at a second posture that is different from a first posture, which is a posture during printing, and that is a posture turned over 90 degrees, for example. When the posture of the printer is changed so that the liquid container is positioned above the liquid ejecting head in the vertical direction, the position of the liquid surface in the liquid container becomes higher than the position of the liquid ejecting head.

While in a state in which the posture has been changed, when the standby position of the liquid ejecting head is a position away from the liquid storage portion in the scanning direction, the distance between the liquid storage portion and the liquid ejecting head becomes large, and the water load in the nozzles of the liquid ejecting head becomes extremely large. In such a case, there have been incidents such as the ink continuously leaking through the nozzles of the liquid ejecting head.

SUMMARY

A liquid ejecting apparatus that overcomes the above issue is a liquid ejecting apparatus that includes a liquid ejecting head that ejects a liquid, a liquid storage portion that stores the liquid, a supply flow path that communicates the liquid ejecting head and the liquid storage portion with each other, and an air chamber that is coupled to the supply flow path through a plurality of flow paths. In the liquid ejecting apparatus, the supply flow path includes a filter, the plurality of flow paths are, in the supply flow path, connected upstream from the filter, and the air chamber is positioned at a position higher than the filter when in a first posture that is a posture during use.

DESCRIPTION OF EXEMPLARY EMBODIMENTS

Hereinafter, an exemplary embodiment of a liquid ejecting apparatus will be described with reference to the drawings. Note that the liquid ejecting apparatus of the present exemplary embodiment is an ink jet printer that prints (records) characters, images, and the like on a medium by ejecting ink, serving as an example of a liquid, on the medium such as a sheet of paper.

Outline of Liquid Ejecting Apparatus

Figure 11:
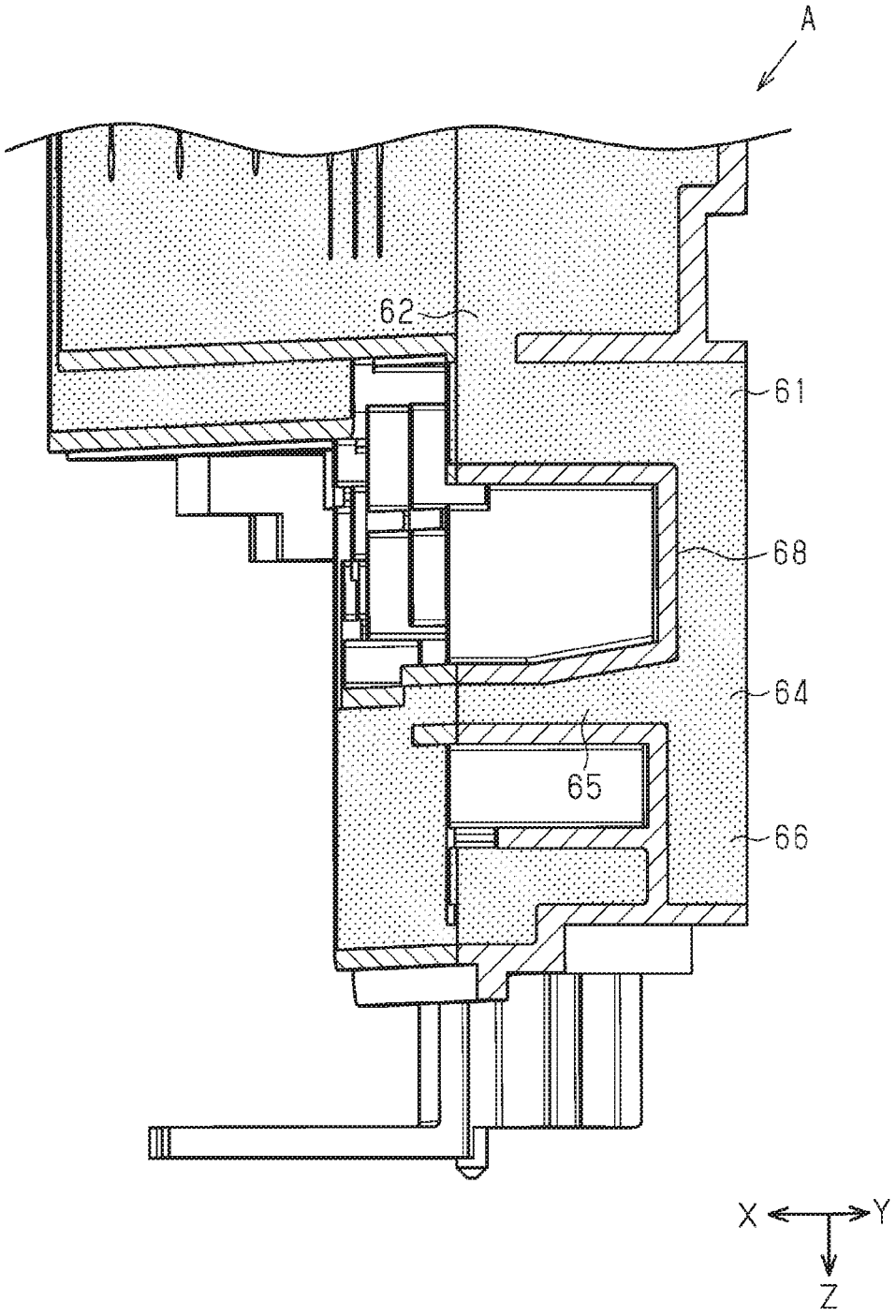
FIG. 11 is a sectional side view of the ink tank in the first posture cut along line XI-XI in FIG. 10.

As illustrated in FIG. 11, a multifunction machine 11 includes a liquid ejecting apparatus 12, and an image reading apparatus 13 that is disposed above the liquid ejecting apparatus 12 and that covers an upper side of the liquid ejecting apparatus 12. The overall multifunction machine 11 is formed in a substantially rectangular parallelepiped shape.

Figure 1:
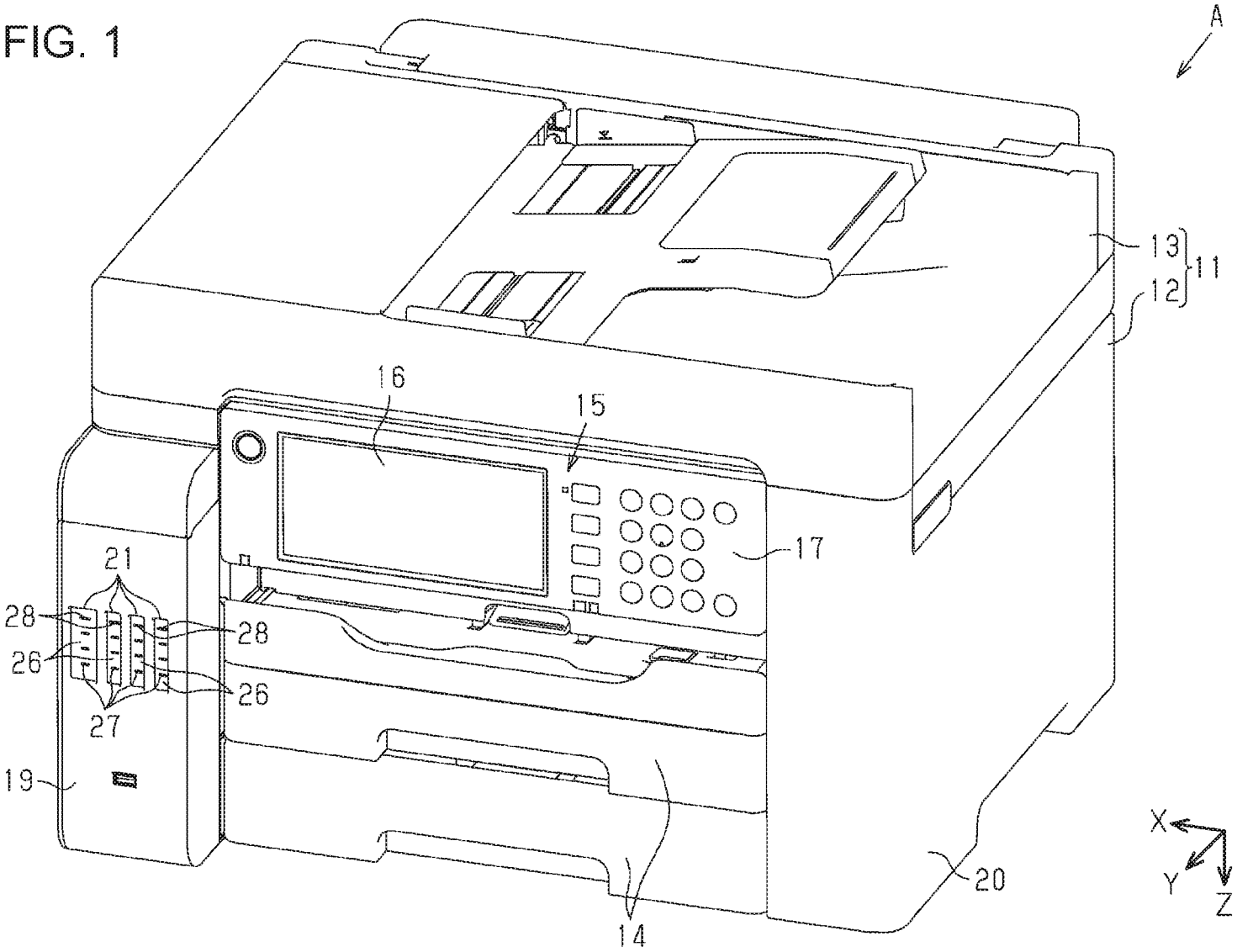
FIG. 1 is a perspective view illustrating an exemplary embodiment of a liquid ejecting apparatus.

In FIG. 1, it is assumed that the multifunction machine 11 is mounted on a horizontal surface and in a first posture A that is a posture of use that is suitable for using the multifunction machine 11. The gravitational direction is indicated by a Z-axis, and directions that extend along a horizontal surface perpendicular to the gravitational direction are indicated by an X-axis and a Y-axis. The X-axis, the Y-axis, and the Z-axis are orthogonal to each other. In the description hereinafter, a direction extending along the X-axis is referred to as a width direction X, a direction extending along the Y-axis is referred to as a depth direction Y, and a direction extending along the Z-axis is referred to as a vertical direction Z. The width direction X, the depth direction Y, and the vertical direction Z intersect (orthogonal, for example) each other. One end side in the depth direction Y may be referred to as a front surface side or a front side, and the other end side that is opposite the one end side may be referred to as a rear surface side or a rear side. One end side in the width direction X viewed from the front surface side may be referred to as a right side and the other end side may be referred to as a left side. The upper side in the vertical direction Z and the lower side in the vertical direction Z are also referred to as an upper side and a lower side. Not limited to vertically above and vertically below, the upper side and the lower side also include the upper side and the lower side that are deviated in the horizontal direction with respect to vertically above and vertically below.

An operation panel 17 that includes an operation portion 15 including buttons that are operated to give various instructions to the multifunction machine 11, and a display portion 16 that displays information of the liquid ejecting apparatus 12 and the image reading apparatus 13 is provided on the front surface side of the liquid ejecting apparatus 12. Medium accommodation portions 14 in which the mediums are accommodated are mounted below the operation panel 17 in a detachable manner.

Furthermore, a holding portion 19 that holds, in the present exemplary embodiment, four ink tanks 45 (see FIG. 2) that stores ink, serving as an example of a liquid, is provided on the left sides of the operation panel 17 and the medium accommodation portions 14. The holding portion 19 includes four window portions 21 through which liquid surfaces of the ink inside the four ink tanks 45 can be visibly recognized.

Figure 2:
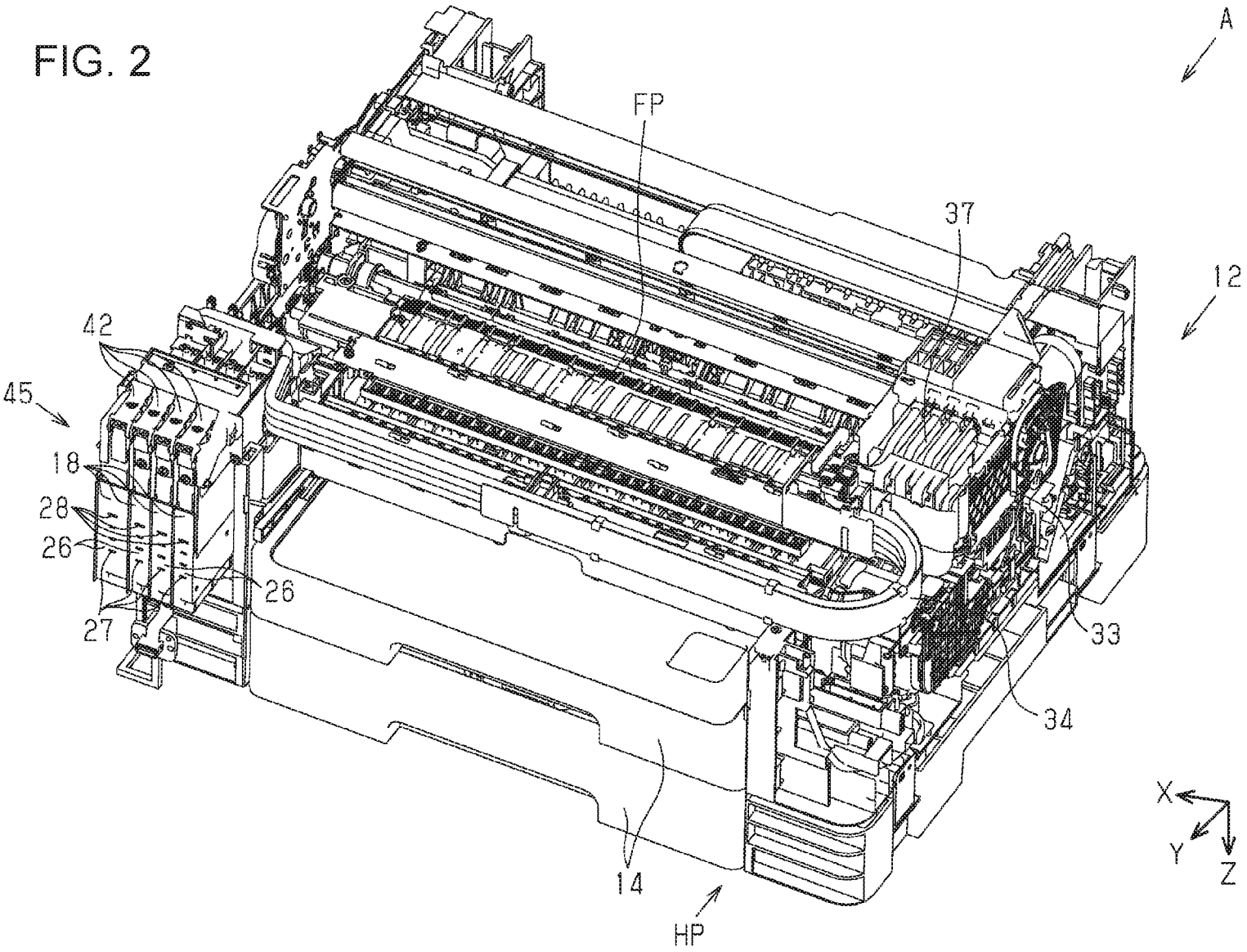
FIG. 2 is a perspective view illustrating the liquid ejecting apparatus in which the illustration of a housing is omitted.

As illustrated in FIG. 2, the ink tanks 45 are provided inside a housing 20 (see FIG. 1) of the liquid ejecting apparatus 12. Each ink tank 45 includes a liquid storage portion 18 that stores a liquid, a filling port 24 (see FIG. 3) provided in an upper portion of the liquid storage portion 18 and through which the liquid can be filled, and an operating lever 42 that includes a cap that seals the filling port 24. The liquid storage portions 18 are disposed at positions opposing the four window portions 21 (see FIG. 1). Scales are formed on surface portions of the liquid storage portions 18 that oppose the four window portions 21.

As illustrated in FIG. 2, the liquid ejecting apparatus 12 of the present exemplary embodiment is a serial printer and includes a carriage 33 configured to move in the width direction X. In the present exemplary embodiment, the ink tanks 45 are provided on the left side in the housing 20 of the liquid ejecting apparatus 12 (see FIG. 1), and a home position HP that is a standby position of the carriage 33 is positionally set on the right side in the housing 20 (see FIG. 1). Ink supply tubes 34, the number thereof being the same as the number of ink tanks 45 (four, in the present exemplary embodiment), are in communication with sub tanks 37 included in the carriage 33 so that the liquids in the ink tanks 45 are supplied to a liquid ejecting head 32 (see FIG. 3) mounted on the carriage 33.

A transport path FP that has a width that is wider than a width of a medium having the largest width extends in the depth direction Y at a middle portion of the liquid ejecting apparatus 12 in the width direction X. The medium supplied from the medium accommodation portion 14 with a transport portion (not shown) is transported along the transport path FP in a transport direction extending from the rear side towards the front side of the liquid ejecting apparatus 12. The carriage 33 positioned at the home position HP and the ink tanks 45 are positioned at opposite sides that interpose the transport path FP in the width direction X.

Figure 3:
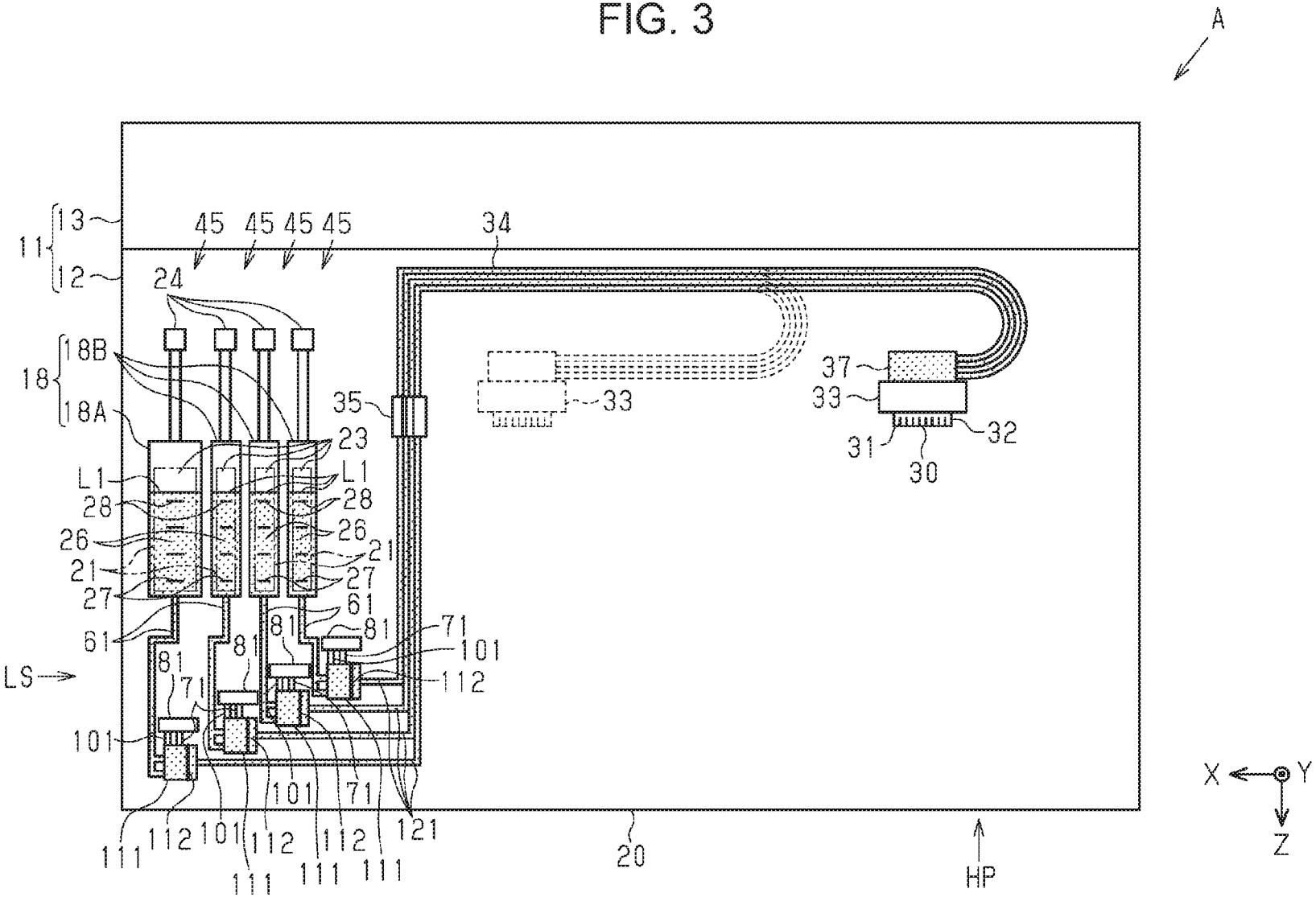
FIG. 3 is a schematic diagram illustrating an internal configuration of the liquid ejecting apparatus in a first posture.

As illustrated in FIG. 3, each liquid storage portion 18 includes a storage chamber 23 configured to store a liquid. Liquids of different types are stored in the storage chambers 23. In the present exemplary embodiment, the types of liquids are types of colors of the liquids such as, for example, cyan, magenta, yellow, and black, and a different type of liquid is stored in each storage chamber 23. A single first liquid storage portion 18A for black ink, in which the stored amount is large, and three second liquid storage portions 18B for colored ink, in which the stored amount is smaller than that of the first liquid storage portion 18A, are provided. The first liquid storage portion 18A is provided on the leftmost side.

The liquid storage portions 18 include the filling ports 24 through which the liquids can be filled into the storage chambers 23. Each liquid storage portion 18 is formed of a transparent or translucent resin; accordingly, a level of a liquid surface L1 of the liquid stored in each storage chamber 23 can be visually recognized from the outside.

In the liquid storage portions 18, areas of the housing 20 that correspond to the window portions 21 function as visually recognizing surfaces 26 through which the ink inside the storage chambers 23 can be visually recognized. A lower limit scale 27 that indicates the recommended time to refill the liquid to the storage chamber 23, and an upper limit scale 28 that indicates the recommended upper limit of the liquid that can be stored in the storage chamber 23 are provided on the visually recognizing surface 26. Note that the visually recognizing surfaces 26 are provided so as to extend in the vertical direction Z when the liquid ejecting apparatus 12 is at the first posture A.

The liquid ejecting apparatus 12 includes the liquid ejecting head 32 configured to eject the liquids. The liquid ejecting head 32 is held by the carriage 33 configured to reciprocate in a scanning direction (the width direction X). The liquid ejecting head 32 includes a plurality of nozzles 31 open in a nozzle formation surface 30 that is a surface that opposes the medium transported through the transport path FP (see FIG. 2). The liquid ejecting head 32 performs printing by moving and ejecting the liquids towards the medium (not shown), and by adhering the ejected liquids to the medium.

Principle of Liquid Leakage Suppression

As illustrated in FIG. 3, the liquids consumed in the liquid ejecting head 32 when printing and the like are supplied from the liquid storage portions 18, through the ink supply tubes 34, and to the liquid ejecting head 32. A liquid leakage suppressing mechanism LS is provided in the flow path route between the liquid storage portions 18 and the ink supply tubes 34. The liquid leakage suppressing mechanism LS suppresses the leakage of the liquids from the nozzles 31 of the liquid ejecting head 32 even when the posture of the liquid ejecting apparatus 12 is changed from the first posture A illustrated in FIG. 3 that is a posture of the liquid ejecting apparatus 12 when printing is performed to a posture in which the housing 20 is turned over 90 degrees during a non-printing period with the object of conveying or storing the liquid ejecting apparatus 12.

As illustrated in FIG. 3, in the present exemplary embodiment, when in the first posture A, openings of the nozzles 31 are at a position that is somewhat higher than that of the liquid surfaces in the ink tanks 45. Accordingly, liquid leakage from the nozzles 31 due to a water head difference between the liquid surfaces in the ink tanks 45 and the openings of the nozzles 31 do not occur.

Figure 4:
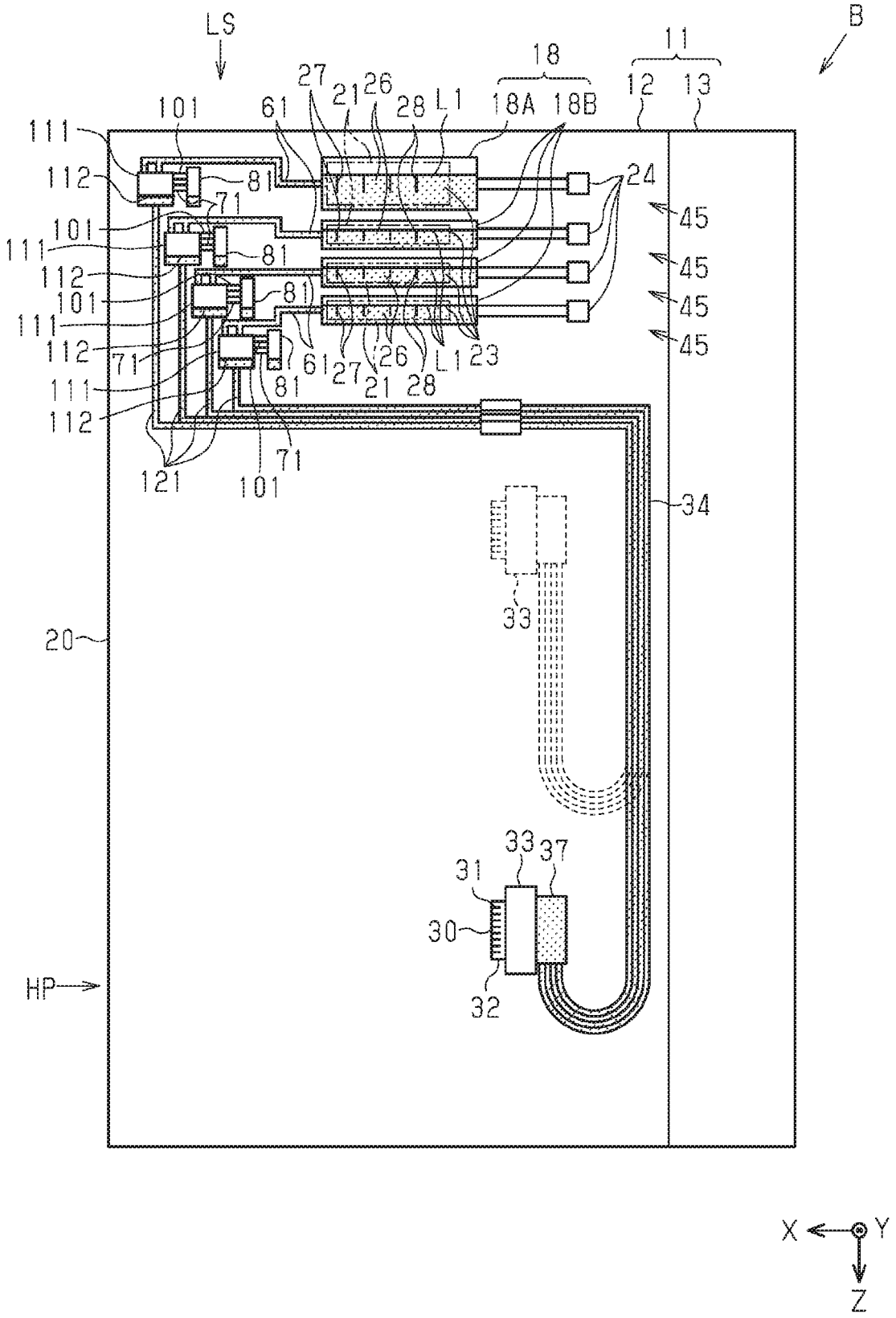
FIG. 4 is a schematic diagram illustrating an internal configuration of the liquid ejecting apparatus in second posture.

As illustrated in FIG. 4, a state in which the posture of the liquid ejecting apparatus 12 is changed during transportation, for example, so that the positions of the liquid surfaces L1 of the liquid storage portions 18 are higher than those of the nozzles 31 of the liquid ejecting head 32 is referred to as a second posture B. FIG. 4 illustrates a state in which FIG. 3 has been turned 90 degrees in the clockwise direction and illustrates positional states of the ink tanks 45 and the carriage 33 when the liquid ejecting apparatus 12 is in the second posture B.

In the second posture B in which the housing 20 is turned over 90 degrees, the water head difference between the liquid surfaces in the ink tanks 45 positioned above and the openings of the nozzles 31 positioned below becomes large; however, by forming gas-liquid interfaces between the liquids and the air and forming a plurality of meniscuses in the gas-liquid interfaces, the liquid leakage suppressing mechanism LS using the surface tension of the meniscuses suppresses water loads acting on the nozzles 31.

The liquid leakage suppressing mechanism LS of the present exemplary embodiment uses filters 112 that remove foreign matters in the liquids. The filters 112 include a plurality of capillary tubes formed of a plurality of pores. The liquid leakage suppressing mechanism LS generates a bubble point pressure, which is a pressure in the direction opposite the water load, by forming the gas-liquid interfaces in the filters 112 and with surface tension of the plurality of meniscuses formed in the plurality of capillary tubes. The bubble point pressure is measured as a pressure needed when, by applying pneumatic pressure from one surface side of the filter in the liquid and by pushing out, with pneumatic pressure, the liquid inside the capillary tubes formed by the pores of the filter, bubbles are created from the opposite surface of the filter. The pressure needed to push out the liquid forming the meniscuses in the capillary tubes of the filters is considerably large compared with the pressure needed for the liquid to pass through the filters in the liquid. When the liquid ejecting apparatus 12 is in the second posture B, the liquid leakage suppressing mechanism LS forms meniscuses in the capillary tubes formed by the plurality of pores in the filters 112, and suppresses the liquid leakage from the nozzles 31 by reducing the water loads on the openings of the nozzles 31 by using the pressure created by the surface tension of the meniscuses.

Figure 5:
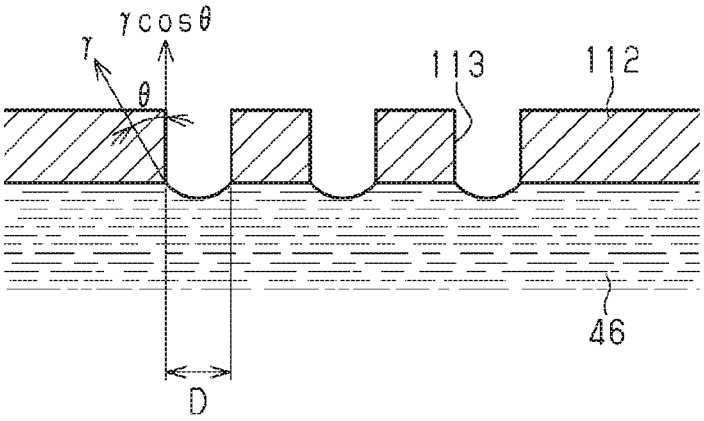
FIG. 5 is a schematic diagram illustrating capillary force acting on pores of a filter when the amount of liquid is at the lower limit.
Figure 6:
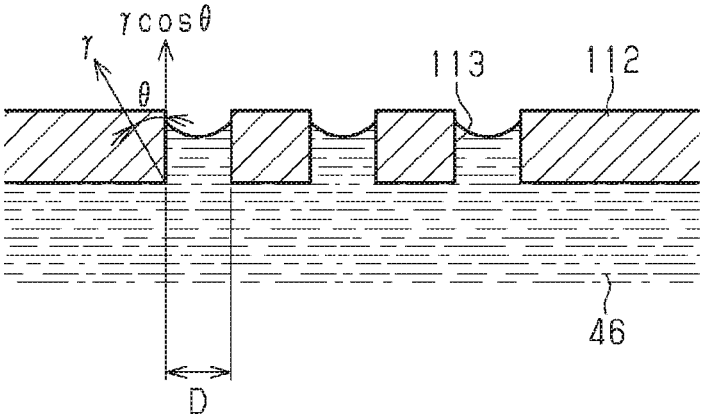
FIG. 6 is a schematic diagram illustrating the capillary force acting on the pores of the filter when the amount of liquid is at the upper limit.

As illustrated in FIGS. 5 and 6, there are a plurality of pores 113 in the surface of the filter 112. When the surface of the filter 112 is covered by air, a surface tension of a liquid 46 forms a concaved meniscus in the entire circumference of the inner wall of each pore 113, which generates capillary force. A condition for the concaved meniscus to be formed is the liquid surface being concavely curved at the wall surface of the pore 113. As illustrated in FIG. 5, when the meniscuses are formed in the lower surface of the filter 112, the liquid surface is at the lowest, and as illustrated in FIG. 6, when the meniscuses are formed in the upper surface of the filter 112, the liquid surface is at the highest.

When $\gamma$ is an interfacial tension of the liquid, $\theta$ is a contact angle of the liquid 46, D is a pore diameter of the pore 113 in the filter 112, and r is a pore radius, the component of force ($\gamma\times\cos q$) of the advancing-direction component of the interfacial tension of the liquid 46 acts on the entire circumference ($2\times\pi\times r$) of the inner wall of the circular tube where the meniscus is formed, and the acting force is ($\gamma\times\cos q\times\pi\times D$). When the above is divided by the area ($\pi\times D^2/4$) of the pore 113, a pressure P ($=4\times\gamma\times\cos q/D$) generated by the capillary force that acts on the meniscus can be obtained.

Generally, the wettability of the ink that is used against the filter 112 is determined; accordingly, in order to increase the capillary force, a filter 112 formed of a material in which the sectional area of the capillary tube formed by the pore 113 is small and in which the contact angle against the ink is large is selected. As described above, by designing a flow path having the filter 112 installed therein, the bubble point pressure can be increased. Since moving of the ink through the filter 112 can be eliminated by setting the bubble point pressure to be larger than the water load, leaking of the ink from the nozzles 31 of the liquid ejecting head 32 can be prevented even when in the second posture B (see FIG. 4) in which the water load becomes large.

For example, a meshed body, a porous body, a perforated plate in which minute through holes are formed, and the like can be used as the filter 112. A filter of a meshed body includes wire netting, a resin net, a mesh filter, and metal fiber. A filter of metal fiber includes a felt filter, which is a stainless steel fine wire formed in a felt-like manner, and a metallic sintered filter, which is a stainless steel fine wire that has been compressed and sintered. A filter of a perforated plate includes an electroforming metal filter, an electron beam processing metal filter, and a laser beam machining metal filter. A mesh filter is a filter formed by weaving wire, and includes a plain-woven, a twill-woven, a plain dutch weave, and a twilled dutch weave filters.

In particular, in order to not have the foreign matter in the liquid reach the nozzles 31, the nominal filtration rating of the filter 112 is preferably set to about 15 μm that is smaller than a diameter (20 μm, for example) of each opening portion of the nozzle 31.

In such a case, when the liquid is ink (the surface tension being about 28 mN/m, for example), the bubble point pressure, which is a pressure at which the meniscus formed in the hole in the filter 112 brakes, is from about 3 kPa to about 5 kPa. Furthermore, when the twilled dutch weave filter (the nominal filtration rating being 5 μm) is adopted, the bubble point pressure is from about 10 kPa to about 15 kPa.

In the present exemplary embodiment, liquid surfaces in filter chambers 111 in the second posture B are set to be at a height that allows the meniscuses to be formed, as illustrated in FIG. 5, at lower openings of the capillary tubes formed by the pores 113 in the filters 112. Furthermore, even if the liquid surfaces in the filter chambers 111 in the second posture B rise above the anticipated liquid surface height (FIG. 5) due to some kind of reason including bubbling of the ink, and the like, the present exemplary embodiment is configured to generate the bubble point pressure as long as the liquid surfaces do not rise above the liquid surface that allows the meniscuses to be, as illustrated in FIG. 6, formed in the upper openings of the capillary tubes formed by the pores 113.

As illustrated in FIG. 4, even if there is the slightest amount of liquid remaining on the upper surfaces of the filters 112, the meniscuses are not formed in the capillary tube formed by the pores 113 (see FIGS. 5 and 6). In such a case, since the bubble point pressure is not generated, the ink leaks from the nozzles 31 of the liquid ejecting head 32 due to the water loads. However, as the ink moves, the liquid will gradually disappear from the upper surfaces of the filters 112. When the meniscuses (see FIG. 6) are formed on the upper surfaces of the filters 112, capillary force is generated; accordingly, any further leaking of the ink from the nozzles 31 of the liquid ejecting head 32 can be prevented.

Outline of Ink Tank

Figure 7:
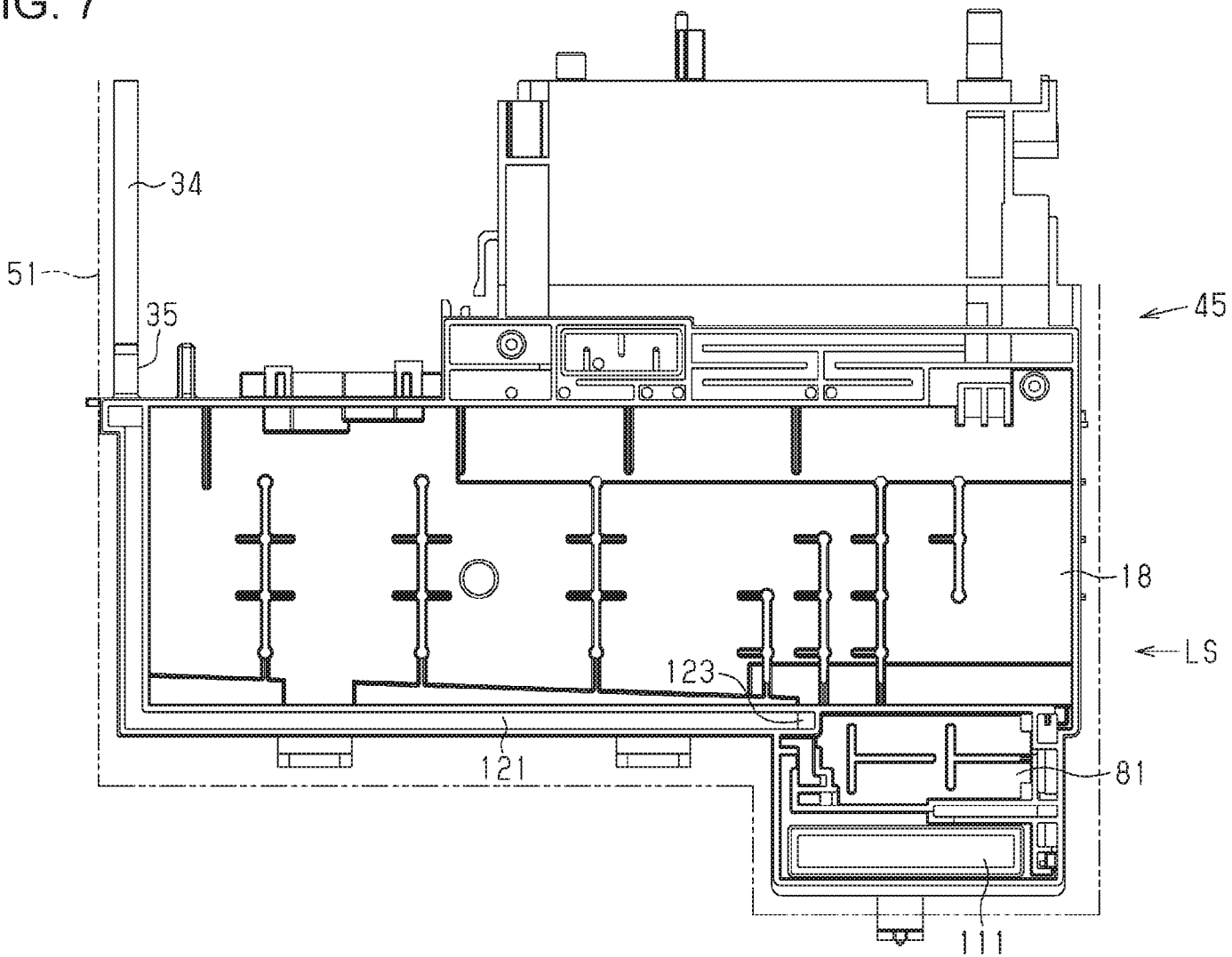
FIG. 7 is a front view illustrating the entire ink tank of the liquid ejecting apparatus.

While four ink tanks 45 are provided in the present exemplary embodiment, for the sake of simplifying the drawing, a single ink tank 45 is illustrated in FIG. 7. Other than the amount of storage being larger, since the configuration of the first liquid storage portion 18A that has a large liquid storing amount and that is for black ink is substantially the same as those of the plurality of ink tanks 45, a description of a single ink tank 45 will be given and description of the other ink tanks 45 will be omitted.

In the ink tank 45, the near side with respect to the sheet surface of FIG. 7 is referred to as the front side, and the far side with respect to the sheet surface is referred to as the back side. Furthermore, in a state in which the ink tank 45 is attached to the liquid ejecting apparatus 12, a side of the ink tank 45 positioned on the back side is referred to as the back side, a side of the ink tank 45 positioned on the front side is referred to as the front side, the upper side in the vertical direction Z is referred to as the upper side, and the lower side in the vertical direction Z is referred to as the lower side.

As illustrated in FIG. 7, in the present exemplary embodiment, the ink tank 45 is configured as a single component in which the liquid storage portion 18 that is a storage portion of the ink, an air chamber 81, the filter chamber 111, and a plurality of flow paths are integrally molded. The liquid leakage suppressing mechanism LS is configured of the air chamber 81, the filter chamber 111, and the plurality of flow paths that communicate the air chamber 81 and the filter chamber 111 with each other.

FIG. 7 illustrates the ink tank 45 when the liquid ejecting apparatus 12 is in the first posture A. When in the first posture A, the air chamber 81 is positioned above the filter chamber 111. The filter chamber 111 is divided into two chambers, namely, a chamber on the front side and a chamber on the back side, with the filter 112 interposed in between. When the liquid ejecting apparatus 12 being turned over 90 degrees is in the second posture B, the two chambers that constitute the filter chamber 111 and that interpose the filter 112 in between are configured to be arranged in the vertical direction (a direction orthogonal to the sheet surface in FIG. 7).

Figure 8:
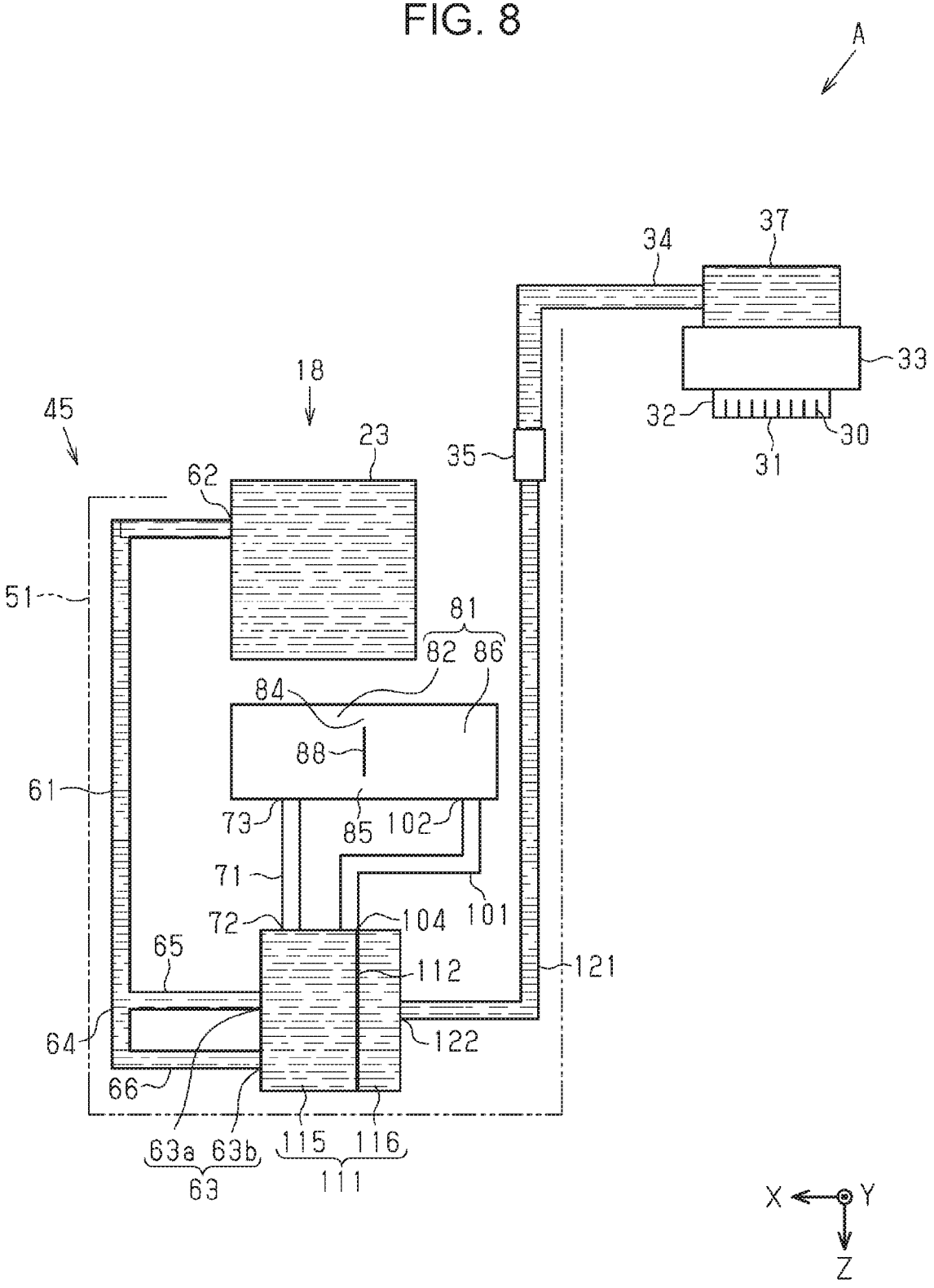
FIG. 8 is a schematic diagram illustrating a supply flow path of the liquid ejecting apparatus in the first posture.

As illustrated in FIG. 8, the ink tank 45 includes the liquid storage portion 18 that includes the storage chamber 23 that stores the ink, serving as an example of the liquid. The liquid passing through a supply flow path 51 flows from the liquid storage portion 18 towards the nozzles 31 of the liquid ejecting head 32. A direction in which the liquid flows is referred to as downstream, and a direction opposite the above is referred to as upstream.

The supply flow path 51 that communicates the liquid storage portion 18 and the liquid ejecting head 32 with each other includes, midway thereof, a filter 112. In the present exemplary embodiment, the liquid flowing from upstream to downstream is made to pass through the filter 112 by including the filter chamber 111 midway of the supply flow path 51 and providing the filter 112 inside the filter chamber 111. Accordingly, foreign matters present in the liquid upstream of the filter 112 is removed by the filter 112 and incidents such as the foreign matters flowing to the nozzles 31 can be reduced in the flow path between a liquid outlet portion 62 of the liquid storage portion 18 to the nozzles 31 of the liquid ejecting head 32. In the supply flow path 51, a flow path from the liquid outlet portion 62 to upstream coupling portions 63 of the filter chamber 111 is referred to as an upstream supply path 61, and a flow path from a downstream coupling portion 122 of the filter chamber 111 to the sub tank 37 is referred to as a downstream supply path 121.

As illustrated in FIG. 8, in the liquid ejecting apparatus 12, in the supply flow path 51 that communicates the liquid storage portion 18 and the liquid ejecting head 32 with each other, a plurality of flow paths are coupled to the air chamber 81 at a portion upstream of the filter 112 of the filter chamber 111. In the present exemplary embodiment, a first flow path 71 and a second flow path 101 each communicate the filter chamber 111 and the air chamber 81 with each other. In the first posture A that is an installed state when the user uses the apparatus (FIGS. 1 to 3), the liquid ejecting head 32 is at a position higher than that of the ink tank 45. The air chamber 81 is at a position higher than that of the filter 112, and the first flow path 71 and the second flow path 101 are coupled to the supply flow path 51 at positions that are higher than that of the filter 112; accordingly, air is collected inside the air chamber 81 and the air chamber 81 is filled with air.

Figure 9:
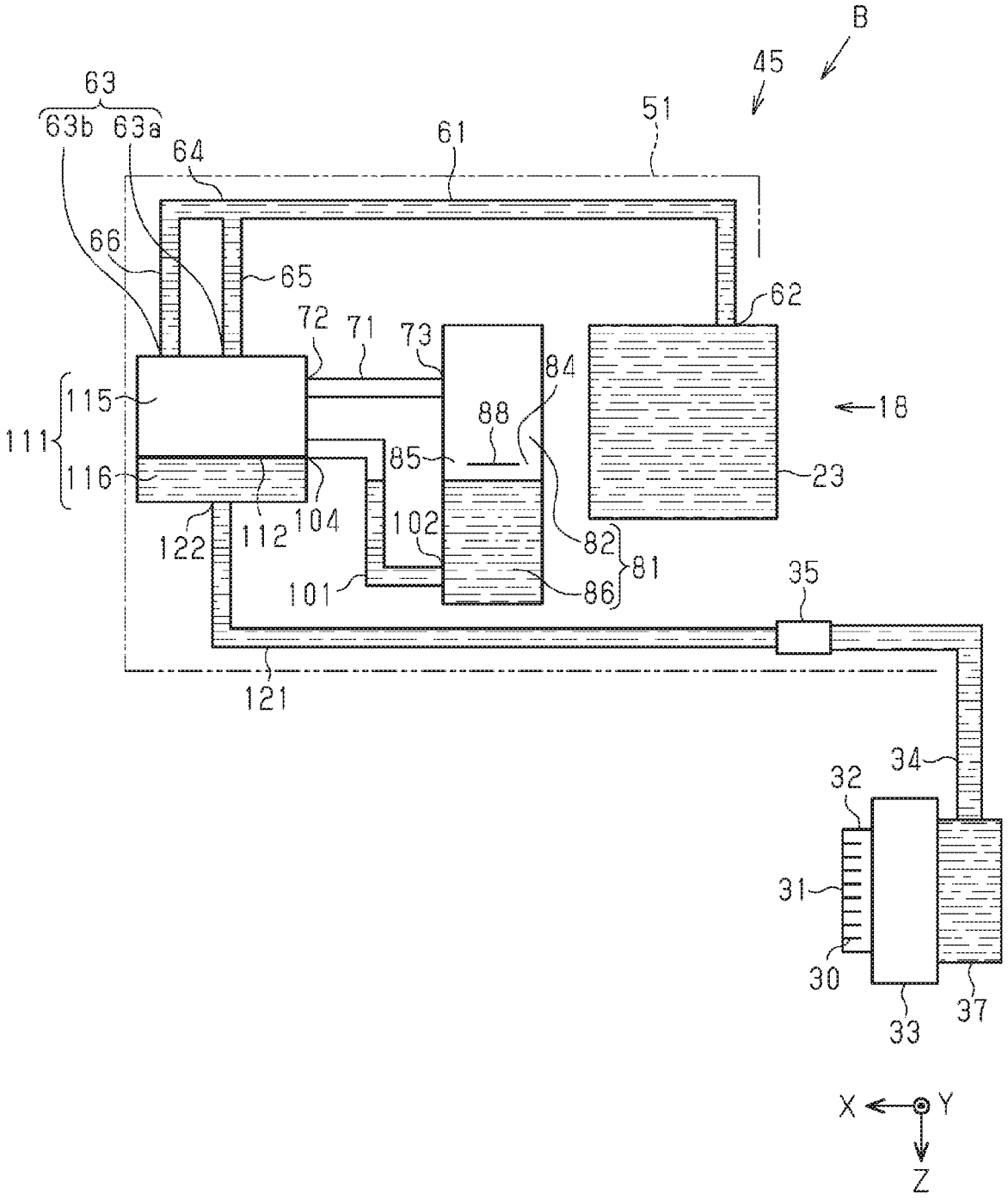
FIG. 9 is a schematic diagram illustrating the supply flow path of the liquid ejecting apparatus in the second posture.

As illustrated in FIG. 9, the second posture B denotes a state in which the posture of the liquid ejecting apparatus 12 is changed, during transportation, for example, so that the positions of the liquid surfaces L1 of the liquid storage portions 18 are higher than those of the nozzles 31 of the liquid ejecting head 32. FIG. 4 illustrates a state in which FIG. 3 has been rotated 90 degrees in the clockwise direction, and FIG. 9 illustrates a state in which FIG. 8 has been rotated 90 degrees in the clockwise direction.

As illustrated in FIG. 9, when in the second posture B in which the liquid storage portion 18 is positioned vertically above the liquid ejecting head 32, the first flow path 71 and the second flow path 101 communicate the filter chamber 111 and the air chamber 81 with each other at positions above the filter 112 of the filter chamber 111. Furthermore, in the present exemplary embodiment, the first flow path 71 is on the upper side with respect to the second flow path 101. In other words, a second flow path output port 104, in which the second flow path 101 is coupled to the filter chamber 111, is below a first flow path input port 72, in which the first flow path 71 is coupled to the filter chamber 111.

Since each of the first flow path 71 and the second flow path 101 couples the filter chamber 111 and the air chamber 81 to each other, at least a portion of the liquid positioned above the filter 112, influenced by gravity, moves into the second flow path 101. A volume of air that is the same as the volume of the liquid that has been moved moves from the air chamber 81 to the filter chamber 111 through the first flow path. The air that has been stored in the air chamber 81 gradually moves to the filter chamber 111 in the above manner. A configuration in which the air flows into a portion above the filter 112 is obtained by having the air stored in the air chamber 81 move to the filter chamber 111.

As illustrated in FIG. 9, in the second posture B, in which the liquid storage portion 18 is vertically above the liquid ejecting head 32, a portion of the air chamber 81 is positioned below the filter 112. Furthermore, the present exemplary embodiment is configured so that the sum of the volumetric capacity of the air chamber 81 positioned below the filter 112 and the volumetric capacity of the second flow path 101 positioned below the filter 112 is larger than the volumetric capacity of a portion of the filter chamber 111 upstream the filter 112. Accordingly, as long as the liquid ejecting apparatus 12 is positioned in the second posture B, the liquid surface in the filter chamber 111 does not exceed above the height of the filter 112 and a state in which the air stored in the air chamber 81 covers the surface of the filter 112 is maintained.

Flow Path from Ink Tank to Filter Chamber

The upstream supply path 61 that is a flow path from the liquid outlet portion 62 of the liquid storage portion 18 to the upstream coupling portions 63 of the filter chamber 111 will be described first.

Figure 10:
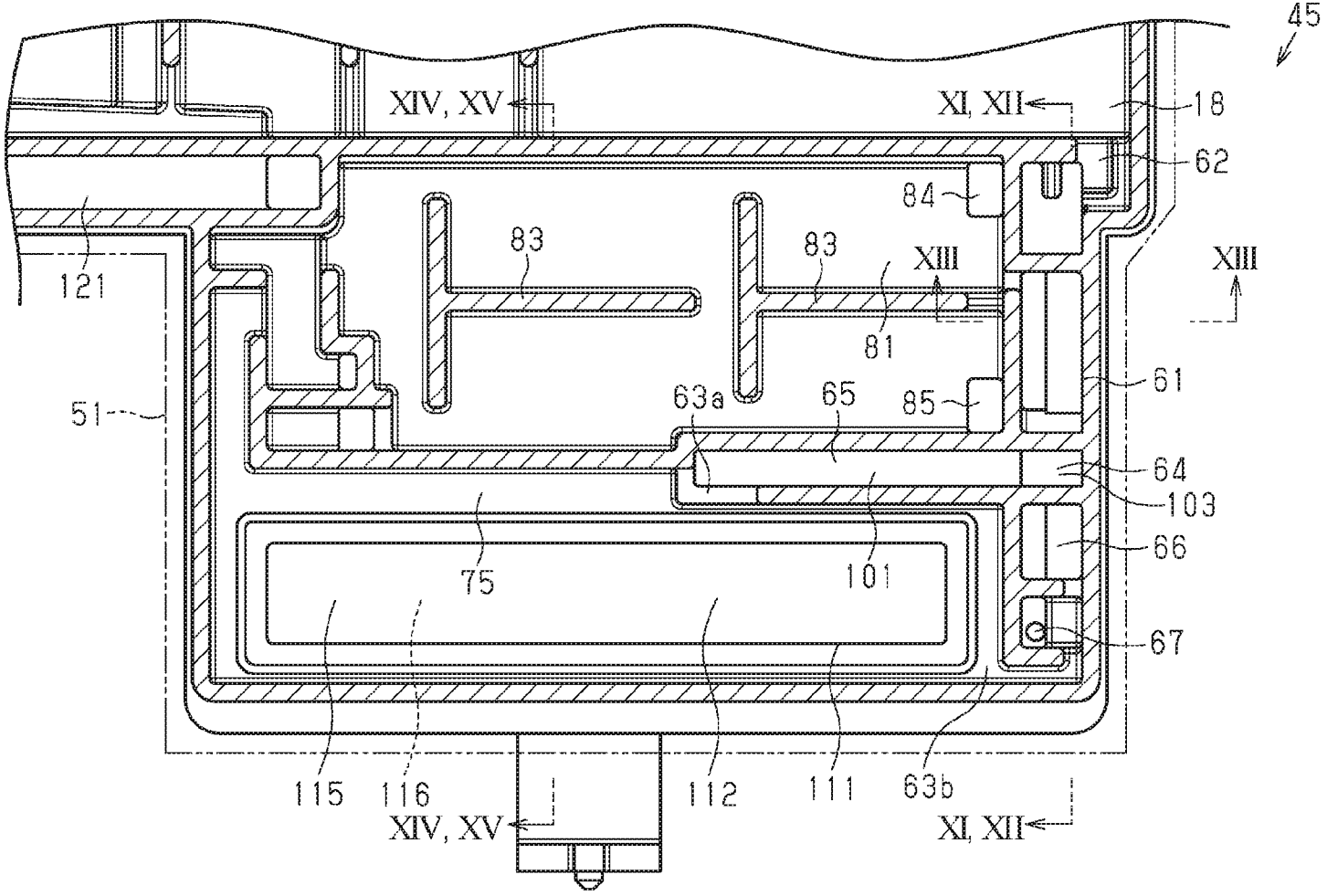
FIG. 10 is a front view illustrating a flow path to a filter chamber of the ink tank.

As illustrated in FIG. 10, the liquid outlet portion 62 is situated at a lower portion of the liquid storage portion 18, and the upstream supply path 61 extends downwards. There is a flow path branching point 64 midway of the upstream supply path 61. The flow path branching point 64 branches the upstream supply path 61 into an upper flow path 65 and a lower flow path 66. The upper flow path 65 is bent to the left side in FIG. 10 at the flow path branching point 64, extends to an upper coupling portion 63*a* that is one of the upstream coupling portions 63, and reaches the surface of the filter 112. In other words, the liquid outlet portion 62 and the upper coupling portion 63*a* are in communication with each other, and the ink can move through the upper flow path 65 of the upstream supply path 61.

Furthermore, the lower flow path 66 extends further downwards in FIG. 10 at the flow path branching point 64, passes a lower communication hole 67, which is situated on the right side of the filter chamber 111, from the far side to the near side in FIG. 10, is bent to the right, downwards, and to the left at short distances, extends to a lower coupling portion 63*b* that is one of the upstream coupling portions 63, and reaches the surface of the filter 112. In other words, the liquid outlet portion 62 and the lower coupling portion 63*b* are in communication with each other, and the ink can move through the lower flow path 66 of the upstream supply path 61. In the present exemplary embodiment, the lower communication hole 67 is a throttle hole and a flow-path cross-sectional area of the throttle hole is smaller than a minimum flow-path cross-sectional area of the lower flow path 66. The flow-path cross-sectional area of the lower communication hole 67 takes a value within a range of, for example, 1/20 to 1/2 of the minimum cross-sectional area of the lower flow path 66. Note that the value is not limited within the above range as long as the lower communication hole 67 functions as a throttle. Flow resistance of the ink is increased by reducing the hole size of the lower communication hole 67.

As illustrated in FIG. 11, when in the second posture B, the upstream supply path 61 is a flow path in which a portion protrudes towards the vertical direction Z side. The flow path of the upstream supply path 61 is formed on the front side in the liquid outlet portion 62; however, midway of the flow path, the flow path extends towards the back side from the front side, for some distance passes a protruded portion 68 that forms the flow path on the back side, and reaches the flow path branching portion 64.

Furthermore, as illustrated in FIG. 10, the flow path extends again to the front side from the back side, and thereafter forms a flow path in which the upper flow path 65 is formed on the front side, that extends to the upper coupling portion 63*a*, and that reaches the surface of the filter 112.

Figure 12:
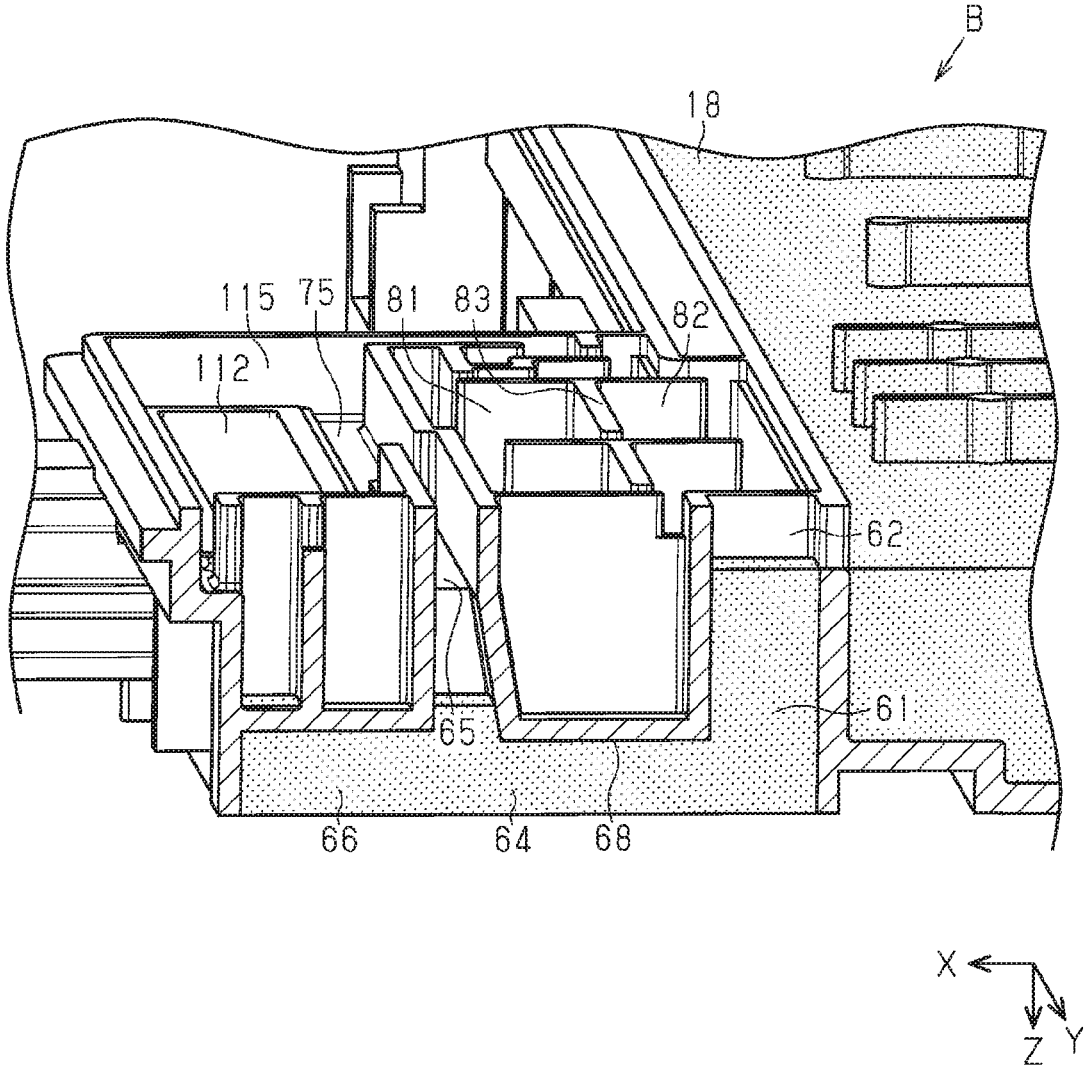
FIG. 12 is a sectional side view of the ink tank in the second posture cut along line XII-XII in FIG. 10.

As illustrated in FIG. 12, when in the second posture B such as, for example, during transportation, a portion of the supply flow path 51 (see FIG. 10) that communicates the liquid storage portion 18 and the filter 112 with each other becomes a flow path that protrudes towards the vertical direction Z side. In the protruded portion 68, since the supply flow path 51 passes through a position that is lower than the filter 112, the supply flow path 51 has a shape in which the air in the filter chamber 111 does not easily flow out through the upstream supply path 61 to the ink tank 45 side. In the present exemplary embodiment, while at least a portion of the portion in the supply flow path 51 (see FIG. 10), which communicates the liquid storage portion 18 and a portion of the flow path in the supply flow path 51 (see FIG. 10) in which the filter 112 is installed with each other, passes the position that becomes lower than the filter 112 when in the second posture B, the entire above portion may pass the position that becomes lower than the filter 112.

Figure 13:
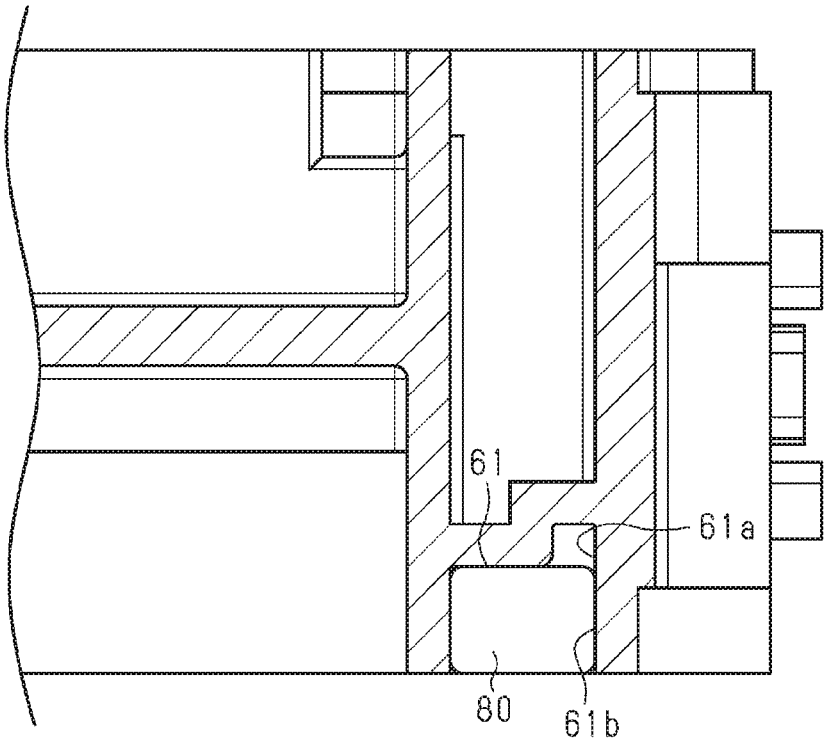
FIG. 13 is a sectional bottom view of the ink tank in the first posture cut along line XIII-XIII in FIG. 10.

As illustrated in FIG. 13, a cross section of the flow path that extends downwards from the liquid outlet portion 62 (see FIG. 10) at the lower portion of the liquid storage portion 18 and that reaches the flow path branching point 64 (see FIG. 10) of the upstream supply path 61 is not a simple square and a groove portion 61*a* is formed at one corner. The cross-sectional shape of the upstream supply path 61 is not a simple square hole and the groove portion 61*a* is provided at one corner of the square hole. The upstream supply path 61 includes a pipe portion 61*b* and the groove portion 61*a*. Compared with the flow-path cross-sectional area of the pipe portion 61*b*, the flow-path cross-sectional area of the groove portion 61*a* is small. The flow-path cross-sectional area of the groove portion 61*a* is 1/4 of the flow-path cross-sectional area of the pipe portion 61*b*, for example. The reason for the above will be described later.

Flow Path from Filter Chamber to Air Chamber

Figure 14:
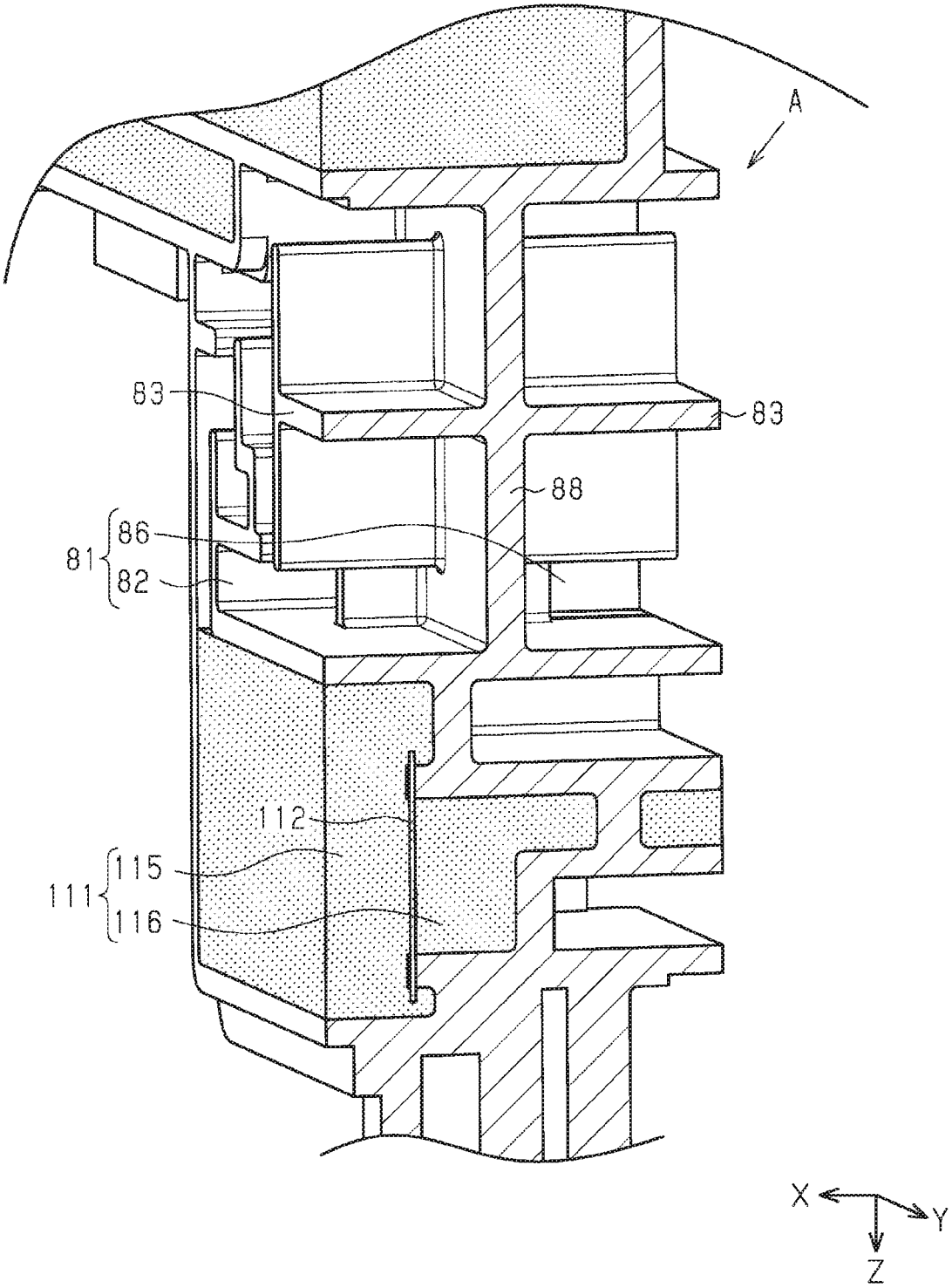
FIG. 14 is a sectional side view of the ink tank in the first posture cut along line XIV-XIV in FIG. 10.
Figure 15:
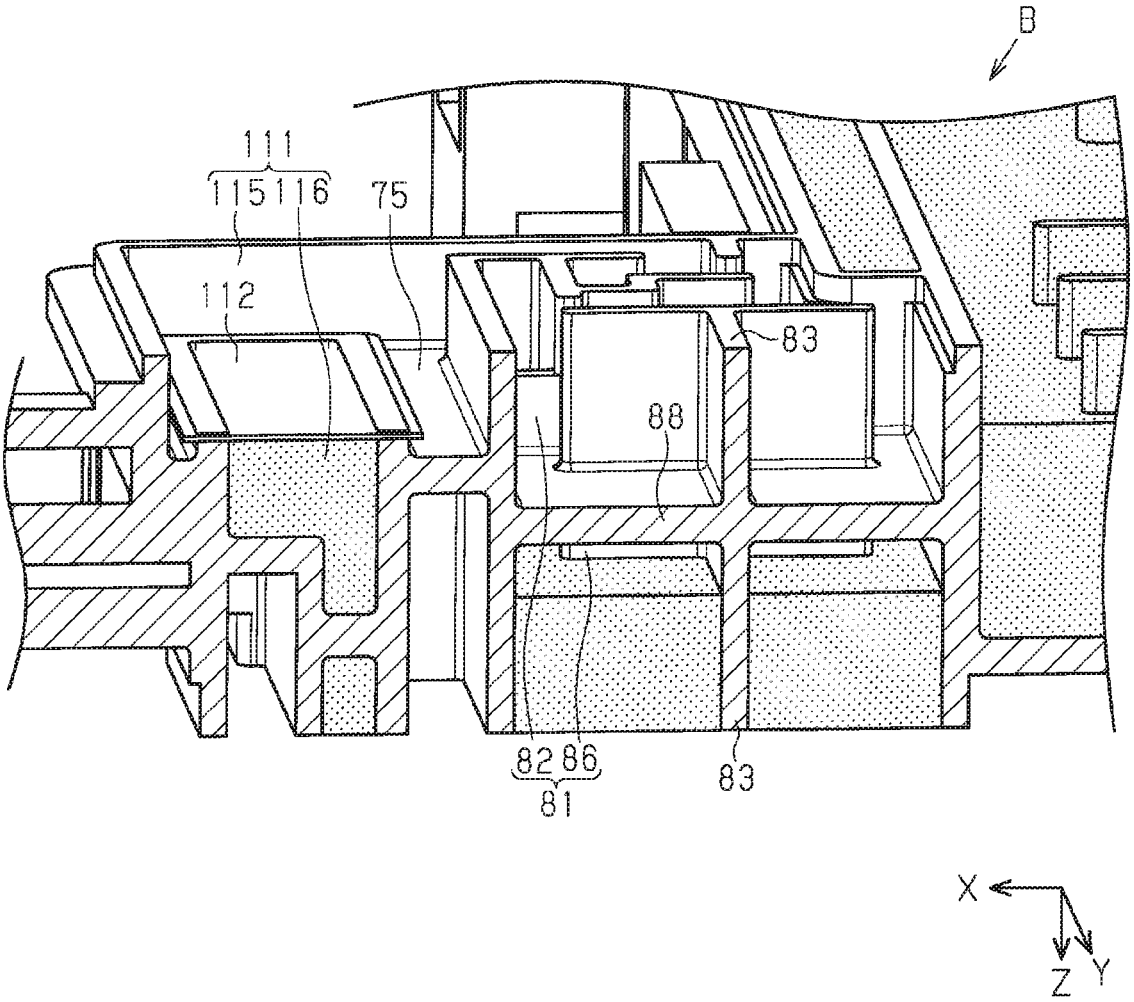
FIG. 15 is a sectional side view of the ink tank in the second posture cut along line XV-XV in FIG. 10.

Referring next to FIGS. 14 and 15, the first flow path 71 (see FIGS. 8 and 9) and the second flow path 101 (see FIGS. 8 and 9) that are flow paths that couple the filter chamber 111 and the air chamber 81 to each other will be described. FIG. 14 illustrates a state of the ink inside the flow path when the liquid ejecting apparatus 12 is in the first posture A, and FIG. 15 illustrates a state of the ink inside the flow path when the liquid ejecting apparatus 12 is set to the second posture B from the first posture A.

As illustrated in FIG. 14, the filter chamber 111 includes a first filter chamber 115 (front side) situated upstream of the filter 112, and a second filter chamber 116 (back side) situated downstream of the filter 112. The air chamber 81 is divided into two chambers with a division wall 88 at the middle, and includes a first air chamber 82 (front side) upstream of the division wall 88, and a second air chamber 86 (back side) downstream of the division wall 88. The air chamber 81 includes through holes that communicate divided rooms with each other, namely, the first air chamber 82 positioned on the front side of the division wall 88 and the second air chamber 86 positioned on the back side of the division wall 88. In the present exemplary embodiment, the first air chamber 82 and the second air chamber 86 are in communication with each other through two through holes, namely, a first through hole 84 (see FIG. 10) and a second through hole 85 (see FIG. 10).

As illustrated in FIG. 15, the air chamber 81 includes the division wall 88 that horizontally divides the air chamber 81 when in the second posture B. When moved to the second posture B, for example, during transportation, the ink in the first filter chamber 115 (front side) upstream of the filter 112 can move to the first air chamber 82. Since the first air chamber 82 and the second air chamber 86 are in communication with each other, the ink that has flowed out from the first filter chamber 115 (front side) passes through the first through hole 84 (see FIG. 10) and the second through hole 85 (see FIG. 10) and moves to the second air chamber 86 situated below the division wall 88. The division wall 88 is set at a height at which, when in the second posture B, the division wall 88 is at a position that is higher than the liquid surface of the ink that has moved into the air chamber.

As illustrated in FIG. 15, a portion that is upstream of the filter 112 and that becomes lower than the surface of the filter 112 when in the second posture B is provided in the filter chamber 111. A ditch portion 75 is formed in the first filter chamber 115 in the surroundings of the filter 112 that becomes a step lower than the upper surface of the first filter 112 when in the second posture B. In other words, in the first filter chamber 115, the height of the surface of the filter 112 is configured to be a step higher than the height of the surroundings. A bottom surface of the ditch portion 75 is flush with a bottom surface of the first flow path 71 (see FIG. 16) coupled to the first filter chamber 115. The ink inside the first filter chamber 115 flows down to the ditch portion 75 in the surroundings of the filter 112 and further, passes through the first flow path 71 (see FIG. 16) from the ditch portion 75 and flows out to the first air chamber 82 (see FIG. 16). Accordingly, no ink remains on the filter 112. The liquid surface in the first filter chamber 115 becomes lower than the upper surface of the filter 112.

Figure 16:
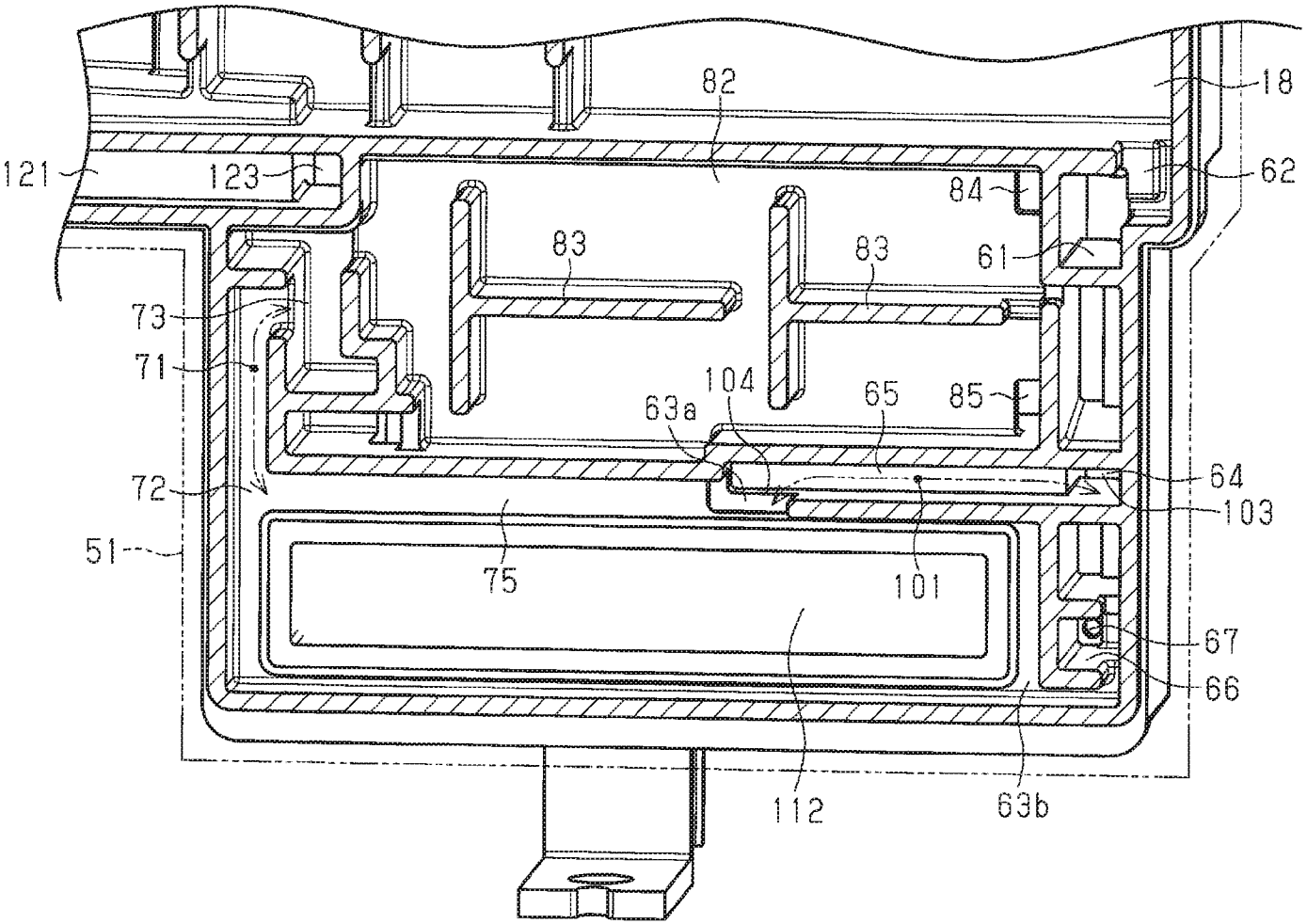
FIG. 16 is a perspective view illustrating a flow path coupling the air chamber and the filter chamber to each other viewed from a front surface side.
Figure 17:
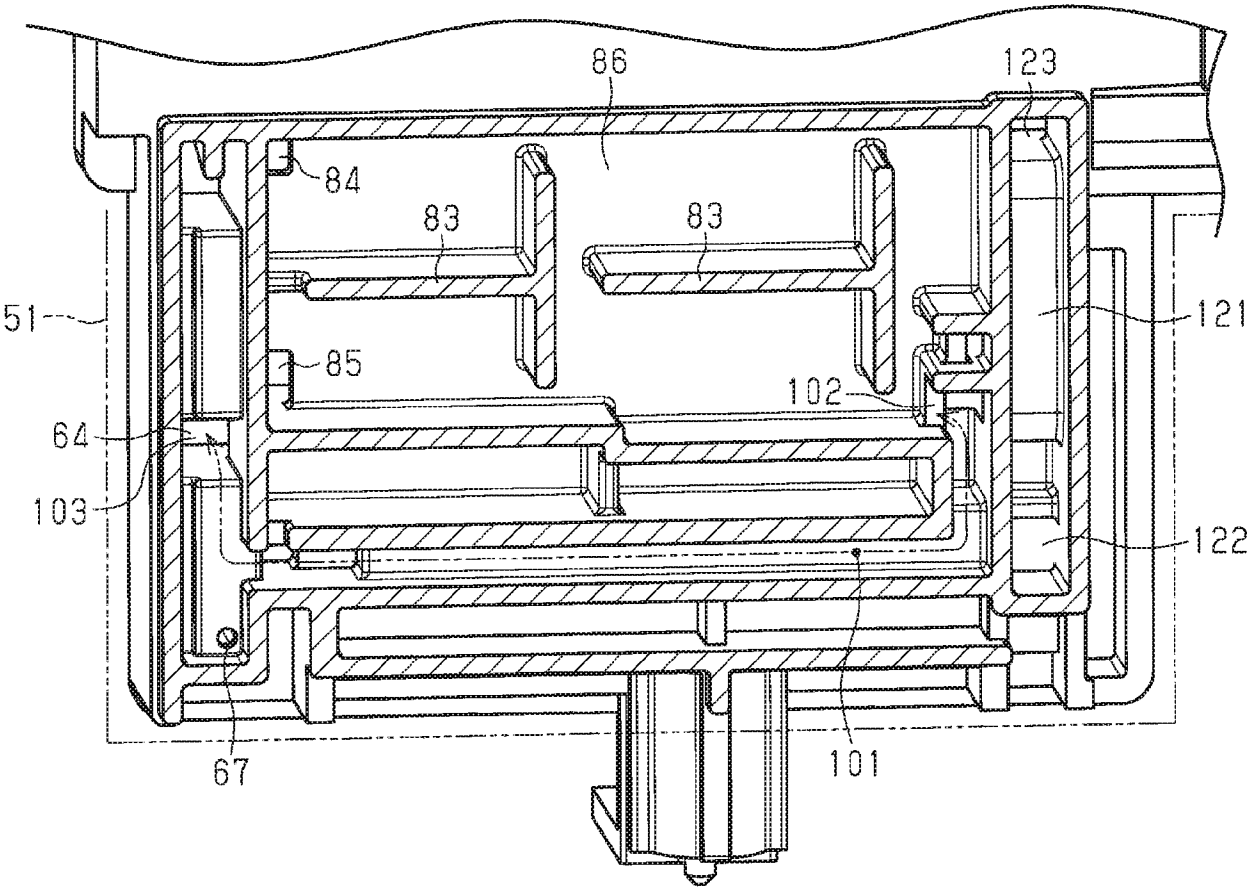
FIG. 17 is a perspective view illustrating a flow path coupling the air chamber and the filter chamber to each other viewed from the rear surface side.

As illustrated in FIGS. 16 and 17, wall portions 83 that each extend in two directions that intersect the division wall 88 are provided in the first air chamber 82 (see FIG. 16) and in the second air chamber 86 (see FIG. 17). In the first air chamber 82 (see FIG. 16), there are two wall portions 83 each of which partitions the space in the chamber into a T-shape, and in the second air chamber 86 (see FIG. 17), there are two wall portions 83 each of which partitions the space in the chamber into a T-shape. In order to allow the ink and the air to move, there is a gap, to a degree allowing the ink and the air to move, between the wall portion 83 and the wall portion 83.

As illustrated in FIG. 10, the upstream supply path 61 from the liquid storage portion 18 to the upper coupling portion 63*a* and the lower coupling portion 63*b* is in communication with the first filter chamber 115.

As illustrated in FIG. 16, the first flow path 71 communicates the first filter chamber 115 and the first air chamber 82 (front side) with each other by coupling the first flow path input port 72 of the first filter chamber 115 (front side) and a first flow path output port 73 of the first air chamber 82 (front side) with each other. The first flow path input port 72 coupled to the first flow path 71 that is in communication with the first filter chamber 115 when in the second posture B is configured to be flush with the ditch portion 75 and a step lower than the height of the surface of the filter 112.

As illustrated in FIGS. 15 to 17, the second flow path 101 communicates the first filter chamber 115 and the second air chamber 86 (back side) with each other by coupling the second flow path output port 104 of the first filter chamber 115 (front side) and a second flow path input port 102 of the second air chamber 86 (back side) with each other. The second flow path output port 104 coupled to the second flow path 101 that is in communication with the first filter chamber 115 when in the second posture B is configured to be slightly higher than the ditch portion 75 and a step lower than the height of the surface of the filter 112.

As illustrated in FIG. 16, at least one of the plurality of flow paths 71 and 101 that are coupled to the air chamber 81 is coupled to the ditch portion 75 that becomes lower than the upper surface of the filter 112 when in the second posture B. In the present exemplary embodiment, the first flow path input port 72 coupled to the first flow path 71 in communication with the first filter chamber 115 (see FIG. 8), and the second flow path output port 104 coupled to the second flow path 101 are configured to be a step lower than the height of the upper surface of the filter 112. Accordingly, when in the second posture B, the liquid on the surface of the filter 112 flows down to the surrounding ditch portion 75 that is configured to be a step lower, passes through the plurality of flow paths 71 and 101 from the ditch portion 75, and moves to the air chamber 81. No ink remains on the filter 112.

As illustrated in FIGS. 16 and 17, the second flow path 101 (see FIGS. 16 and 17) is set with a flow path length that is longer than that of the first flow path 71 (FIG. 16). Specifically, while the first flow path 71 is the shortest flow path and couples the filter chamber 111 and the air chamber 81 to each other, the second flow path 101 is intentionally set with a flow path length that is longer than the shortest flow path.

As illustrated in FIG. 17, after passing through the second flow path input port 102 and extending slightly downwards, the second flow path 101 is bent to the left side and is briefly extended, is bent upwards, is made to pass through a second flow path communication port 103 and move from the back side to the front side, is bent to the left side and is briefly extended as illustrated in FIG. 16, and is made to reach the first filter chamber 115 (front side).

As illustrated in FIG. 16, the position of the second flow path output port 104, which is a terminal point of the second flow path 101, is the same as that of the upper coupling portion 63*a*. The second flow path 101 and the upper flow path 65 share the flow path between the flow path branching point 64 to the first filter chamber 115.

Flow Path from Filter Chamber to Liquid Ejecting Head

Lastly, the downstream supply path 121, which is a flow path from the downstream coupling portion 122 of the filter chamber 111 to the liquid ejecting head 32, will be described.

As illustrated in FIG. 17, the ink that has passed through the filter 112 (see FIG. 16) passes through the downstream coupling portion 122 and moves to the back side (FIG. 17) from the front side (FIG. 16), is directed to the upper side, briefly moves upwards, passes through a downstream supply path communication port 123, and moves to the front side from the back side.

As illustrated in FIG. 7, after passing through the downstream supply path communication port 123 and moving to the front side, the liquid is directed to the left side, is moved along the under surface of the ink tank 45, is directed to the upper side at the corner, is made to pass through a joint portion 35, and is supplied to the ink supply tube 34 coupled to the sub tank 37 of the liquid ejecting head 32.

Functions of the liquid ejecting apparatus 12 will be described next.

As illustrated in FIG. 2, when assembling of the liquid ejecting apparatus 12 is completed in a production line of a production plant of the liquid ejecting apparatus 12, no ink whatsoever is filled in the ink tanks 45, and the ink tanks 45 are filled with air. When the user uses the liquid ejecting apparatus 12 for the first time, the user operates the operating levers 42 and removes the caps, and fills the ink into the ink tanks 45 from the filling ports 24 (see FIG. 3) that the liquid storage portions 18 include in the upper portions thereof.

Before the user starts using the liquid ejecting apparatus 12, the storage chambers 23 of the liquid storage portions 18 in the ink tanks 45 (see FIG. 7) are filled with no ink whatsoever and are filled with air. Furthermore, in the supply flow paths 51 communicating the liquid storage portions 18 and the liquid ejecting head 32 as well, no ink whatsoever is filled therein and air is filled therein.

As illustrated in FIG. 8, when starting to use the liquid ejecting apparatus 12, ink is filled in each ink tank 45. As well as being supplied to the storage chamber 23 of the liquid storage portion 18, the ink from the liquid outlet portion 62 at the lower portion of the liquid storage portion 18 passes through the upstream supply path 61, is branched into the upper flow path 65 and the lower flow path 66 at the flow path branching point 64, and reaches the filter chamber 111. By performing gas-liquid exchange, that exchanges the air in the filter chamber 111 with the ink through the upstream supply path 61, the filter chamber 111 is filled with the ink.

As illustrated in FIG. 13, in the upstream supply path 61, air 80 passes through the pipe portion 61*b* and flows into the liquid storage portion 18 (see FIG. 10), and the ink passes through the groove portion 61*a* and flows into the filter chamber 111 (see FIG. 10). Since a strong capillary force acts in the groove portion 61*a* and the ink is drawn to the groove portion 61*a*, the air 80 cannot enter the above portion. Accordingly, since the groove portion 61*a* functions as a flow path dedicated for the ink, the gas-liquid exchange is performed through the upstream supply path 61. If the cross-sectional shape of the upstream supply path 61 is a simple square shape, the upstream supply path 61 will be completely blocked by the air 80 in the upstream supply path 61 moving upstream; accordingly, gas-liquid exchange will not be able to be performed.

As illustrated in FIG. 10, the ink flowing through the upstream supply path 61 flows from the flow path branching point 64 to the lower flow path 66 by its own weight and, through the lower flow path 66, flows into the filter chamber 111 from the lower coupling portion 63*b* open at the lower portion of the filter chamber 111. When the ink flows into the filter chamber 111, air having a volume that is equivalent to the volume of the ink that has flowed in is pushed out from the filter chamber 111. In the above, since the air inside the filter chamber 111 is lighter than the ink, the air passing through the upper flow path 65 is pushed out from the upper coupling portion 63*a* that is open at the upper portion of the filter chamber 111. When the air reaches the flow path branching point 64, the air passes through the pipe portion 61*b* in the upstream supply path 61 and flows out to the liquid storage portion 18. In so doing, the ink passes through the groove portion 61*a* (see FIG. 13) in the upstream supply path 61 and flows to the flow path branching point 64 by capillary force, and flows through the lower flow path 66 into the filter chamber 111 by its own weight. The filter chamber 111 is filled with ink by having the gas-liquid exchange be smoothly performed in the above manner through the upstream supply path 61.

However, since there are two supply paths, an unintended movement of ink may occur at times such as when the apparatus is turned over and when vibration is generated. Accordingly, the lower communication hole 67 that has a small flow path diameter is provided midway of the lower flow path 66 to increase the flow resistance of the ink.

Once the filter chamber 111 is filled with ink, the ink moves to the filter chamber 111 through the upper flow path 65 and the lower flow path 66.

As illustrated in FIG. 3, when, in the first posture A (see FIG. 3), the liquid is consumed for printing and the like at the liquid ejecting head 32, the liquid in the liquid storage portion 18 is supplied to the liquid ejecting head 32 through the ink supply tube 34 so as to compensate the consumed ink.

As illustrated in FIG. 3, when in the first posture A (see FIG. 3), no position of the liquid ejecting head 32 in the scanning direction (the width direction X) will change the height relationship between the liquid ejecting head 32 and the ink tanks 45. In the above, the water loads of the nozzles 31 of the liquid ejecting head 32 are desirably a negative pressure from about −500 Pa to −1 kPa. As in the present exemplary embodiment, when the height of the nozzle formation surface 30 of the liquid ejecting head 32 is high with respect to the liquid surfaces L1 in the liquid storage portions 18, the water load in the nozzles 31 will be a negative pressure.

As illustrated in FIG. 8, when in the first posture A (see FIG. 3), the first flow path 71 and the second flow path 101 that communicate the air chamber 81 and the filter chamber 111 to each other are coupled to the filter chamber 111 at positions that are higher than that of the filter 112. Accordingly, when the user uses the liquid ejecting apparatus 12 for the first time and when the ink is filled into the liquid ejecting apparatus 12 for the first time, the filled ink does not flow into the air chamber 81 and, subsequently, even when in the first posture A (see FIG. 3) that is a use state of the liquid ejecting apparatus 12, the air chamber 81 is filled with air.

As illustrated in FIG. 4, when the posture of the liquid ejecting apparatus 12 is changed from the first posture A (see FIG. 3) to the second posture B (see FIG. 4), the ink tanks 45 are positioned above the carriage 33, which is standing by at the home position HP, by a distance corresponding to the largest medium width.

When in the first posture A (see FIG. 3), the nozzles 31 of the liquid ejecting head 32 are at a position that is higher than that of the liquid surfaces L1 of the ink tanks 45; however, when in the second posture B (see FIG. 4), while the positions of the ink tanks 45 are the uppermost position in the housing 20, the position of the carriage 33 is the lowermost position in the housing 20. The distance between the ink tanks 45 and the liquid ejecting head 32 becomes extremely large. In known configurations, the water loads in the nozzles 31 of the liquid ejecting head 32 become extremely high; accordingly, there are incidents in which the ink kept on leaking through the nozzles 31 of the liquid ejecting head 32.

As illustrated in FIG. 9, when the posture of the liquid ejecting apparatus 12 is changed from the first posture A (see FIGS. 3 and 8) to the second posture B (see FIGS. 4 and 9), the second flow path output port 104, which is where the second flow path 101 is coupled to the filter chamber 111, is below the first flow path input port 72, which is where the first flow path 71 is coupled to the filter chamber 111. Accordingly, the liquid positioned above the filter 112, owing to gravity, moves to the second flow path 101 through the second flow path output port 104 positioned below. A volume of air that is the same as the volume of the liquid that has been moved moves from the first flow path 71 through the first flow path output port 73 and flows into the filter chamber 111.

As illustrated in FIG. 15, since the height of the surface of the filter 112 is a step higher than the height of the surroundings, the ink flows down from the filter 112 to the surroundings and no ink remains on the filter 112.

As illustrated in FIG. 16, when in the second posture B, the first flow path input port 72 coupled to the first flow path 71 that is in communication with the first air chamber 82 is positioned a step higher than the height of the surface of the filter 112. Furthermore, when in the second posture B, the second flow path output port 104 coupled to the second flow path 101 that is in communication with the second air chamber 86 (see FIG. 17) is positioned a step lower than the height of the surface of the filter 112. In other words, when in the second posture B, the ink influenced by gravity moves to the air chamber 81 (see FIG. 9) through the first flow path input port 72 positioned at the ditch portion 75 configured a step lower, and through the second flow path output port 104 positioned slightly higher than the ditch portion 75 but a step lower than the height of the surface of the filter 112.

Accordingly, no ink remains on the surface of the filter 112 and the surface is covered by air.

As illustrated in FIG. 6, meniscuses are formed in the plurality of pores 113 in the surface of the filter 112. Bubble point pressure in the direction opposite the water load is generated by the surface tension of the meniscuses formed in the plurality of pores 113 in the surface of the filter 112. As illustrated in FIG. 9, since the bubble point pressure is set larger than the water load, there will be no movements of the ink inside the second filter chamber 116; accordingly, flowing out of the ink to the downstream supply path 121 will not occur. Accordingly, as illustrated in FIG. 4, even when in the second posture B (see FIG. 4) in which the water head difference between the liquid surfaces L1 of the liquid storage portions 18 and the openings of the nozzles 31 of the liquid ejecting head 32 becomes large, since a pressure amounting to the bubble point pressure is reduced, there will be no application of a water load large enough to create liquid leakage in the nozzles 31. Accordingly, leakage of the ink from the nozzles 31 of the liquid ejecting head 32 can be prevented.

As illustrated in FIG. 17, the second flow path 101 is intentionally set to be a long flow path. When the posture of the liquid ejecting apparatus 12 is changed from the first posture A (see FIG. 3) to the second posture B (see FIG. 4), there are cases in which the ink in the air chamber 81 (see FIG. 9) slightly moves through the second flow path 101 towards the filter chamber 111 (see FIG. 9) due to the wave in the ink generated by the vibration and impact when the liquid ejecting apparatus 12 is turned over. While the first flow path 71 is situated at the same height as that of the air chamber 81 (see FIG. 16), since the second flow path 101 is situated below the air chamber 81 (see FIG. 17), the ink tends to become moved by vibration and impact.

As illustrated in FIG. 9, even when the ink in the air chamber 81 attempts to move through the second flow path 101 and into the filter chamber 111, since the second flow path 101 is formed with a flow path length that is longer than that of the first flow path 71 (see FIG. 17), the ink that has been moved by vibration and impact does not easily reach the filter chamber 111. It will be difficult for the ink to reach the filter chamber 111 by the volumetric capacity increased by lengthening the second flow path 101. The second flow path 101 that is a long flow path functions as a buffer that prevents unintended movement of the ink.

As illustrated in FIG. 10, even when, due to the ink being vibrated by the vibration and impact created when the liquid ejecting apparatus 12 had been turned over, the ink inside the liquid storage portion 18 attempts to move through the lower flow path 66 and towards the filter chamber 111, the lower communication hole 67 formed of the throttle hole becomes a flow path resistance to the ink and moving of the ink is suppressed. Accordingly, after the liquid ejecting apparatus 12 is turned over to the second posture B, the ink, influenced by the vibrating of the ink inside the liquid storage portion 18 caused by the vibration and impact when the liquid ejecting apparatus 12 had been turned over, can be suppressed from flowing from the lower flow path 66 into the filter chamber 111.

As illustrated in FIG. 15, when in the second posture B, a portion of the air chamber 81 is positioned at a position that is lower than that of the filter 112. Accordingly, the liquid that has moved to the air chamber 81 can be suppressed from returning to the filter chamber 111 and covering the upper surface of the filter 112. In the present exemplary embodiment, when in the second posture B, the entire second air chamber 86, which is the air chamber 81 on the lower side, is positioned at a position that is lower than that of the filter 112. Accordingly, there are fewer incidents such as the liquid that has moved to the air chamber 81 returning to the filter chamber 111, and the liquid can be further suppressed from covering the upper surface of the filter 112 once again.

As illustrated in FIG. 9, when in the second posture B, the ink from the first filter chamber 115 that has reached the first air chamber 82 through the first flow path 71 passes through the two through holes, namely, the first through hole 84 and the second through hole 85, and moves to the second air chamber 86 situated below the division wall 88. Furthermore, since the ink that has moved through the second flow path 101 reaches the second air chamber 86, the ink is collected in the second air chamber 86.

As illustrated in FIG. 15, when in the second posture B, the division wall 88 is, to serve as a barrier, disposed at a position above the ink accumulated in the second air chamber 86 so that even when the liquid ejecting apparatus 12 is vibrated during conveying, bubbling of the ink is suppressed by having the wave generated in the ink inside the air chamber 81 hit the division wall 88. When bubbling occurs in the ink, the volume of the ink increases and the ink flows into the filter chamber 111 more easily; however, the division wall 88 can suppress bubbling of the ink. In other words, with the bubbling suppressing effect of the division wall 88, bubbly ink can be prevented from entering the second flow path 101 (see FIG. 9) that is a flow path coupled to the filter chamber 111.

As illustrated in FIGS. 16 and 17, the first air chamber 82 and the second air chamber 86 includes the wall portions 83 that protrude in directions intersecting the division wall 88. By partitioning the first air chamber 82 and the second air chamber 86 into a plurality of small rooms with the wall portions 83, a large movement of the liquid is suppressed so that a large wave is not generated. The wave in the ink, which is generated when the liquid ejecting apparatus 12 is vibrated during conveying, can be suppressed by having the wave in the ink hit the wall portion 83. When bubbling occurs in the ink due to the wave, the volume of the ink increases and it will be easier for the bubbly ink to enter the second flow path 101, which is the flow path coupled to the filter chamber 111; however, the division wall 88 can suppress bubbling of the ink. In other words, with the function of the wall portion 83, bubbly ink can be prevented from entering the second flow path 101, which is the flow path coupled to the filter chamber 111.

As illustrated in FIG. 3, when the posture of the liquid ejecting apparatus 12 is changed from the second posture B (see FIG. 4) to the first posture A (see FIG. 3) once again, the vertical direction Z between the ink tanks 45 and the carriage becomes short. When in the first posture A (see FIG. 3), the liquid ejecting head 32 returns to the position that is higher than the positions of the ink tanks 45.

As illustrated in FIG. 8, when the posture of the liquid ejecting apparatus 12 is changed from the second posture B (see FIGS. 4 and 9) to the first posture A (see FIGS. 3 and 8), the liquid in the second air chamber 86, influenced by gravity, moves to the second flow path 101 through the second flow path input port 102 positioned below, and returns to the first filter chamber 115. Subsequently, the air in the first filter chamber 115 passing through the first flow path 71 returns to the first air chamber 82 through the first flow path output port 73. When each filter chamber 111 is filled with ink and when each air chamber 81 is filled with air, the state of the flow path returns to the state before the posture of the liquid ejecting apparatus 12 had been changed.

As described above, when the liquid ejecting apparatus 12 is changed from the first posture A (see FIG. 3) to the second posture B (see FIG. 4), a water load that generates liquid leakage in the nozzles 31 is not applied; accordingly, leaking of ink from the nozzles 31 of the liquid ejecting head 32 can be prevented. Furthermore, regarding the impact when the liquid ejecting apparatus 12 is changed from the first posture A to the second posture B when conveying, unpacking, and installing the liquid ejecting apparatus 12 and the vibration during transportation of the liquid ejecting apparatus 12 at the second posture B, the functions of the division wall 88 and the wall portion 83 suppress the ink inside the air chamber 81 from moving, which suppresses bubbling of the ink. For example, inconvenience of the meniscuses not being formed in the filters 112 due to bubbling of the ink inside the air chamber 81 is suppressed. In other words, even when there is an impact or vibration when the liquid ejecting apparatus 12 is in the second posture B (see FIG. 4), the ink can be prevented from leaking from the nozzles 31 of the liquid ejecting head 32.

The following effects can be obtained with the exemplary embodiment described above in detail.

(1) When the posture of the liquid ejecting apparatus 12 is changed from the first posture A to the second posture B, the liquid in each first filter chamber 115 that has been at a position above the corresponding filter 112 moves, due to the influence of gravity, through the corresponding second flow path 101, positioned below, to the corresponding air chamber 81 through the corresponding second flow path input port 102. A volume of air that is the same as the volume of the liquid that has been moved enters, through the first flow path output port 73, the first filter chamber 115 from the first flow path 71, and the surface of the filter 112 is covered with air. In other words, the liquid surface of the ink in the filter chamber 111 is flush with the upper surface of the filter 112 or is lower than the upper surface of the filter 112. There are capillary tubes formed of the plurality of pores 113 in each filter 112. When the surface of the filter 112 is covered by air, the surface tension of the ink forms meniscuses of the ink in the capillary tubes formed by the pores 113, which generates a bubble point pressure that counters the water load. Since each filter 112 is set so that the bubble point pressure is larger than the water load, the substantial water load acting on the nozzle 31 is suppressed to a small load considering the water head difference between the liquid surface L1 of the liquid storage portion 18 and the nozzles 31. Accordingly, even in the second posture B in which the water head difference between the liquid storage portion 18 and the nozzles 31 becomes large, leaking of the ink from the nozzles 31 of the liquid ejecting head 32 can be prevented.

(2) When in the first posture A, the first flow path 71 and the second flow path 101 that communicate the air chamber 81 and the filter chamber 111 with each other are coupled to the filter chamber 111 at a position that is higher than that of the filter 112. Accordingly, in the first posture A that is a use state of the liquid ejecting apparatus 12, storing of air in the air chamber 81 is facilitated. By having the air stored in the air chamber 81 at all times, the surface of the filter 112 can be covered by air when in the second posture B; accordingly, leaking of the ink from the nozzles 31 of the liquid ejecting head 32 can be prevented in a stable manner. Furthermore, when in the first posture A, the ink does not accumulate in the plurality of flow paths 71 and 101. For example, if the plurality of flow paths 71 and 101 are configured to accumulate the ink in a portion thereof when in the first posture A, old ink such as, for example, sediment of a pigment that has accumulated in a portion of the plurality of flow paths 71 and 101 may become mixed when returned to the first posture A from the second posture B. However, the plurality of flow paths 71 and 101 are configured so that the ink does not easily accumulate in a portion thereof when in the first posture A; accordingly, the above issue can be avoided.

(3) When the liquid ejecting apparatus 12 is, from the first posture A, turned over and changed to the second posture B, influenced by gravity, the ink in the first filter chamber 115 situated upstream of the filter 112 passes through the second flow path 101 positioned below and moves to the air chamber 81 through the second flow path input port 102. Furthermore, since at least a portion of the air chamber 81 is positioned at a position that is lower than that of the filter 112, compared with a configuration in which all of the air chamber 81 is positioned at a position that is higher than that of the filter 112, the amount of ink that moves to the air chamber 81 is increased further. Furthermore, the present exemplary embodiment is configured so that the sum of the volumetric capacity of a portion of the air chamber 81 positioned below the filter 112 and the volumetric capacity of a portion of the second flow path 101 positioned below the filter 112 is larger than the volumetric capacity of a portion of the filter chamber 111 upstream the filter 112. Accordingly, as long as the liquid ejecting apparatus 12 is positioned in the second posture B, the liquid surface in the filter chamber 111 does not exceed above the height of the filter 112 and a state in which the air stored in the air chamber 81 covers the surface of the filter 112 is maintained.

(4) When in the second posture B, after the ink influenced by gravity flows to the ditch portion 75 configured at a height that is a step lower, the ink on the upstream surface of the filter 112 moves to the air chamber 81 through the first flow path input port 72 and the second flow path input port 102; accordingly, no ink remains on the upstream surface of the filter 112, the surface is covered by air, and meniscuses are formed. Accordingly, when the posture of the liquid ejecting apparatus 12 is changed from the first posture A to the second posture B, leaking of the liquid through the nozzles 31 of the liquid ejecting head 32 can be prevented.

(5) Bubbling of the liquid in the air chamber 81 can be suppressed by disposing the division wall 88 at a position that, when in the second posture B, horizontally divides the air chamber 81 into the first air chamber 82 and second air chamber 86 and by hitting the liquid, which tries to move in the air chamber 81 when the liquid ejecting apparatus 12 in the second posture B is vibrated when being conveyed and the like, against the division wall 88 functioning as a barrier. For example, when the volume of the liquid inside the air chamber 81 is increased by bubbling, the substantial amount of liquid accumulated in the air chamber 81 becomes relatively small; accordingly, the liquid surface, which is an interface between the layer of air and the liquid between the liquid storage portion 18 and the filter 112 rises over the anticipated liquid surface height. In such a case, no meniscuses will be formed in the filter 112, and there is a concern that an inconvenience such as a small amount of liquid leaking from the liquid ejecting head 32 may occur until the meniscuses are formed. However, since bubbling in the air chamber 81 can be suppressed, the above inconvenience can be prevented to the utmost. Furthermore, bubbly liquid can be suppressed from entering the second flow path 101, which is a flow path coupled to the filter chamber 111.

(6) Since the division wall 88 is disposed at a position that is higher than that of the liquid surface in the air chamber 81 when in the second posture B, a concern that the liquid that has moved to the air chamber 81 below the division wall 88 will return to the filter chamber 111 is small, and the volume at which the liquid covers the upper surface of the filter 112 can be suppressed.

Note that when in the second posture, by having the volumetric capacity of the second air chamber 86 that is below the division wall 88 and that is at a position lower than the position of the filter 112 be larger than the volumetric capacity of the first filter chamber 115, the entire liquid in the first filter chamber 115 can be moved to the second air chamber 86. Accordingly, there are fewer incidents such as the liquid that has moved to the second air chamber 86 returning to the filter chamber 111, and the liquid can be suppressed from covering the upper surface of the filter 112 once again.

(7) When in the second posture B, most of the ink from the first filter chamber 115 passes through the second flow path 101 and reaches the second air chamber 86. While it is a small amount, the ink that has moved through the first flow path 71 also moves to the second air chamber 86, which is below the division wall 88, by passing through two through holes, namely, the first through hole 84 and the second through hole 85. In other words, when in the second posture B, the ink can be collected to the lower second air chamber 86.

(8) By partitioning the first air chamber 82 and the second air chamber 86 into a plurality of small rooms with the wall portions 83, the wave in the ink, which is generated when the liquid ejecting apparatus 12 is vibrated by being conveyed and the like, is suppressed by having the wave in the ink hit the wall portion 83. With the above, since a large wave is not generated in the ink inside the air chamber 81, bubbling of the ink is suppressed. Accordingly, the frequency of the meniscuses not being formed due to the liquid surface in the filter chamber 111 rising, which is caused by bubbling of the ink inside the air chamber 81, can be reduced and the amount of ink that leaks from the liquid ejecting head 32 until the meniscuses are formed can be suppressed to a small amount. Furthermore, the bubbly ink can be prevented from entering the second flow path 101, which is a flow path coupled to the filter chamber 111.

Furthermore, when the volume of the ink is increased by bubbling, a case in which the bubbly ink moving over the division wall 88 flowing into the first air chamber 82 can be conceived. In such a case as well, due to the function of the wall portion 83, the bubbly ink can be prevented from entering the first flow path 71, which is a flow path coupled to the filter chamber 111.

(9) When the liquid ejecting apparatus 12 is in the second posture B, since the protruded portion 68 in the portion of the supply flow path 51 communicating the liquid storage portion 18 and the filter 112 with each other passes through a position that is lower than the filter, the air upstream of the filter 112 does not easily flow out towards the ink tank 45 side through the upstream supply path 61.

Note that the exemplary embodiment described above can be modified into the following configurations. Furthermore, the exemplary embodiment described above and a modification described below can be appropriately combined as an additional modification, and the modifications described below can be appropriately combined as an additional modification.

While the filter 112 is provided inside the filter chamber 111, the filter 112 may be provided not in the filter chamber 111 but midway of the supply flow path 51.

While the filter 112 is provided in the filter chamber 111 of the ink tank 45, the liquid leakage suppressing mechanism LS including the filter 112 may be provided outside the ink tank 45. Since it is only sufficient that the liquid leakage suppressing mechanism LS generates a bubble point pressure to the extent to which the movement of the ink caused by the water load does not occur, the liquid leakage suppressing mechanism LS does not necessarily have to be mounted in the ink tank 45 positioned farthest away from the carriage 33.

A plurality of filters 112 may be provided midway of each supply flow path 51 of the corresponding ink tank 45.

The liquid leakage suppressing mechanism LS that includes the filter 112 may be provided at a plurality of portions that are midway of each supply flow path 51 of the corresponding ink tank 45. In each of the liquid leakage suppressing mechanisms LS, a plurality of flow paths may be included upstream of the filter 112, and the plurality of flow paths may each be coupled to a different air chamber 81, or when a plurality of supply flow paths extend from the same ink tank, the number of air chambers 81 that is coupled to the plurality of flow paths each coupled to a corresponding one of the plurality of supply flow paths may be one.

When in the first posture A, a portion of the air chamber 81 may be at a position above the filter 112. It is only sufficient that air is stored in the air chamber 81.

The number of flow paths that couple the air chamber 81 and the supply flow path 51 to each other is not limited to two and can be three or more.

While each ink tank 45 is configured as a single component in which the liquid storage portion 18, which is an ink storage portion of the tank, the air chamber 81, the filter chamber 111, and the plurality of flow paths are integrally molded, the ink tank 45 may be configured of different components coupled to each other.

The storage chamber 23 that stores the liquid, and an atmosphere communication portion that communicates the inside of the storage chamber 23 and the atmospheric air with each other may be provided in the liquid storage portion 18.

When in the first posture A, at least one of the plurality of flow paths that couple the air chamber 81 and the filter chamber 111 to each other is coupled to the supply flow path 51 at a position that is lower than the filter 112 or at a height position that is the same as that of the filter 112.

When in the first posture A, the ink tanks 45 are provided at one end portion in the housing 20 of the liquid ejecting apparatus 12 in the width direction X, and the home position HP, which is the standby position of the carriage 33, is provided at the other end portion in the housing 20; however, the home position HP may be provided on the left side in the housing 20 in FIG. 2.

When in the second posture B, not all of the ditch portion 75 formed in the wall surface of the first filter chamber 115 needs to be configured a step lower than the height of the upstream surface of the filter 112. It is only sufficient that a portion is configured lower. It is only sufficient that there is one flow path into which the ink that has flowed from the surface of the filter 112 flows and to which the first flow path 71 or the second flow path 101 is coupled, and that there is one portion in the flow path that has a difference in height with the surface of the filter 112. Furthermore, the ditch portion 75 does not have to be lower but can be at the same height as that of the surface of the filter 112. However, when the ditch portion 75 is at the same height with the surroundings or when the height difference is small, depending on the angle of inclination or the posture of the liquid ejecting apparatus 12, there are cases in which the function of the ditch portion 75 cannot be exerted; accordingly, it is desirable that, when in the second posture B, the ditch portion 75 is at a position that is lower than the upstream surface of the filter 112.

The first flow path 71 or the second flow path 101, which are plurality of flow paths, does not have to be directly coupled to the ditch portion 75 around the filter 112, and may be coupled to the ditch portion 75 through another flow path. Coupled to the ditch portion 75 includes coupling to the ditch portion 75 through another flow path. In the present exemplary embodiment, the second flow path 101 passes through the second flow path output port 104 that in a step higher than the ditch portion 75.

In a case in which the filter chamber 111 is not provided in the supply flow path 51, the volumetric capacity of the portion of the air chamber 81 positioned below the filter 112 when in the second posture B, and the volumetric capacity of a portion of the second flow path 101 positioned below the filter 112 when in the second posture B are added. The portion in which the volumetric capacities are added is configured to be larger than the volumetric capacity of the portion positioned above the upper surface of the filter 112 when in the second posture B. In such a case, as long as the liquid ejecting apparatus 12 is positioned in the second posture B, the liquid surface does not exceed above the height of the upper surface of the filter 112 and a state in which the air stored in the air chamber 81 covers the surface of the filter 112 is maintained.

When in the second posture, the sum of the volumetric capacity of the air chamber 81 positioned below the filter 112 and the volumetric capacity of the second flow path 101 positioned below the filter 112 does not have to be larger than the volumetric capacity of a portion of the filter chamber 111 upstream the filter 112. When in the second posture B, the amount of liquid remaining in the filter chamber 111 is large, and when the liquid surface in the filter chamber 111 exceeds the height of the filter 112, the ink leaks from the nozzles 31 of the liquid ejecting head 32 due to the water load. However, after the amount of ink that leaks from the nozzles 31 has moved and from when meniscuses are formed in the upper surface of the filter 112 due to gradual ceasing of the liquid from the upper surface of the filter 112, leading of the ink from the nozzle 31 of the liquid ejecting head 32 can be prevented.

As long as at least a portion of the flow path coupling the air chamber 81 and the filter chamber 111 to each other is connected upstream of the filter 112, in the second posture B, at least one of the plurality of flow paths coupling the air chamber 81 and the filter chamber 111 to each other may be coupled to the supply flow path 51 at a position that is higher than the filter 112. However, as in the present exemplary embodiment, when connected to the supply flow path 51 at a position that is lower than the filter 112, due to the height difference, the ink on the surface of the filter 112 flows and the liquid on the surface of the filter 112 gradually ceases; accordingly, meniscuses are more easily formed between the upper surface and the under surface of the filter 112.

The upper flow path 65 coupling the liquid storage portion 18 and the filter chamber 111 to each other and the second flow path 101 coupling the air chamber 81 and the filter chamber 111 to each other may be separately provided.

While the air chamber 81 is divided into two rooms with the division wall 88, the air chamber 81 may be divided into three or more rooms.

While the division wall 88 of the air chamber 81 is configured to be horizontal when in the second posture B, the division wall 88 may not be horizontal but may be at an angle against a horizontal plane. However, as the angle becomes larger, the effect of preventing wave formation and bubbling becomes smaller.

While two T-shaped wall portions 83 are provided in each of the first air chamber 82 and the second air chamber 86, which are formed by dividing the air chamber 81 with the division wall 88, the number of wall portions and the shape of the wall portions are not limited to any number and shape. It is only sufficient that, in order for the ink and air to move, the wall portions 83 are not close to each other and are not crowded by each other, and there are gaps between the wall portion 83 and the wall portion 83 to the extent that allows the ink and the air to move.

Each wall portion 83 of the air chamber 81 may be configured of a member that is different from those of the wall surfaces of the air chamber 81 and the division wall 88.

While the first air chamber 82 and the second air chamber 86 communicate with each other through two through holes, namely, the first through hole 84 and the second through hole 85, the number of through holes and the shape of the through holes are not limited to the above number and shape. It is only sufficient that the size of each through hole is one that allows the ink and the air to move therethrough.

The entire portion of the supply flow path 51 from the liquid storage portion 18 to the filter 112 may pass through a position that is lower than the filter 112 when in the second posture B.

While the flow-path cross-sectional area (the size) of the lower communication hole 67 takes, for example, a value from 1/20 to 1/2 of the minimum flow-path sectional area of the lower flow path 66, the shape and the size is not limited to the above. However, since there is a size appropriate for both initial filling of the ink and suppressing unintended movement of the ink, it is desirable that the size be set to the appropriate size that can achieve both of the above.

After performing test printing during pre-shipment inspection of the liquid ejecting apparatus 12, the liquid ejecting apparatus 12 is shipped from the factory after the ink in the entire liquid ejecting apparatus 12 has been emptied, and the user fills the ink into the ink tanks 45 when using the liquid ejecting apparatus 12 for the first time. When the liquid ejecting apparatus 12 is set to the second posture B during transporting and conveying the liquid ejecting apparatus 12, the ink does not leak from the nozzles 31; accordingly, the step of emptying all of the ink that has been filled in the liquid ejecting apparatus 12 during pre-shipment inspection can be omitted and the liquid ejecting apparatus 12 may be shipped out from the factory.

The liquid ejecting apparatus 12 may be a liquid ejecting apparatus 12 that ejects a liquid other than ink. The state of the liquid ejected as minute amounts of droplets from the liquid ejecting apparatus 12 includes a granular shape, a tear shape, or a shape with a threadlike trail. Furthermore, liquid used herein refers to any material that can be ejected by the liquid ejecting apparatus 12. For example, any material in a liquid state is sufficient and the liquid may include a fluid body, such as a liquid body with high or low viscosity, sol, gel water, and other inorganic solvents, an organic solvent, a solution, liquid resin, liquid metal, and metallic melt. Not just liquid as a state of matter, the liquid includes particles of a functional material including a solid body such as a pigment or metal particle that is dissolved, dispersed, or mixed in a solvent. A representative example of the liquid includes ink, liquid crystal, and others that have been described in the exemplary embodiment described above. Note that ink includes a variety of liquid compositions such as a general aqueous ink, solvent ink, and gel ink, and hot melt ink. Examples of the liquid ejecting apparatus may include, for example, a liquid ejecting apparatus that ejects liquid that includes therein, in a dispersed or dissolved manner, a material such as an electrode material or a color material that is used to manufacture liquid crystal displays, electroluminescence displays, surface emitting displays, and color filters. The liquid ejecting apparatus may include, for example, an apparatus that ejects bio organic matter to manufacture biochips, an apparatus used as a precision pipette that ejects liquid serving as a sample, printing equipment, and a microdispenser. The liquid ejecting apparatus may be an apparatus that ejects lubricating oil in a pinpoint manner onto a precision instrument such as a clock or a camera, an apparatus that sprays transparent liquid resin such as ultraviolet curing resin on a substrate in order to form a hemispherical microlens and an optical lens used in optical communication elements. The liquid ejecting apparatus 12 may be an apparatus that ejects acid, alkaline, or another etching solution for etching substrates and the like.

Technical ideas and the effects perceived from the exemplary embodiment and the modifications described above will be described below.

A liquid ejecting apparatus including a liquid ejecting head that ejects a liquid, a liquid storage portion that stores the liquid, a supply flow path that communicates the liquid ejecting head and the liquid storage portion with each other, and an air chamber that is coupled to the supply flow path through a plurality of flow paths. In the liquid ejecting apparatus, the supply flow path includes a filter, the plurality of flow paths are, in the supply flow path, connected upstream from the filter, and the air chamber is positioned at a position higher than the filter when in a first posture that is a posture during use.

According to such a configuration, when in first posture, since the air chamber coupled to the supply flow path at a portion upstream of the filter is positioned above the filter, there is air in the air chamber. Accordingly, even when the apparatus is turned over and is changed from the first posture to the second posture, the liquid upstream of the filter starts to move to the air chamber through the plurality of flow paths.

When changed to the second posture, since the liquid influenced by gravity moves into at least a portion of portions of the plurality of flow paths and the air chamber that are filled with air when in the first posture, the amount of liquid upstream of the filter decreases, and portions of the air in the plurality of flow paths and in the air chamber amounting to the volume of the liquid that has moved flows upstream of the filter. In other words, a layer of air is formed in the supply flow path between the liquid storage portion and the filter.

When, in the second posture, the liquid surface, which is an interface between the air and the liquid, and the filter overlap each other due to the layer of air between the liquid storage portion and the filter, meniscuses are formed in the capillary tubes formed by the pores in the filter and, due to the surface tensions of the meniscuses, a bubble point pressure, which is a pressure in the direction opposite the water load between the liquid storage portion and the filter, is generated. Furthermore, when, in the second posture, there is liquid on the upper surface of the filter, in other words, when the liquid surface is above the filter, no meniscus is formed; accordingly, due to the water load, the liquid leaks from the liquid ejecting head until the meniscuses are formed. Subsequently, leaking of the ink from the liquid ejecting head can be prevented after the meniscuses are formed in the upper surface of the filter. Accordingly, the amount of liquid leaking from the liquid ejecting head can be suppressed to a small amount. Accordingly, even when the liquid ejecting apparatus is turned over to a posture in which the position of the liquid surface in the liquid storage portion is higher than the position of the liquid ejecting head, leaking of the liquid from the liquid ejecting head can be suppressed.

(B) In the liquid ejecting apparatus described above, when in the first posture, the plurality of flow paths may be coupled to the supply flow path at a position higher than the filter.

According to such a configuration, when in the first posture, the air chamber is positioned vertically above the supply flow path that includes the filter, and the plurality of flow paths that couple the supply flow path and the air chamber to each other are coupled to the supply flow path at a position that is higher than that of the filter; accordingly, the air chamber and the plurality of flow paths are not included in the flow path of the liquid.

Accordingly, when in the first posture, there is, rather than the liquid, air in the air chamber and the plurality of flow paths. Furthermore, the plurality of flow paths are coupled upstream of the filter. Accordingly, when the apparatus is tuned over and is changed to the second posture from the first posture, the liquid in the supply flow path that was upstream of the filter starts to move towards the air chamber through at least one of the plurality of flow paths coupled upstream of the filter in the supply flow path. Since the air chamber and the plurality of flow paths are coupled to the supply flow path at positions that are higher than that of the filter, compared with when only the air chamber is positioned vertically above the filter, the amount of air moving to the air chamber is large.

(C) In the liquid ejecting apparatus described above, when in a second posture that is a posture in which the liquid storage portion is positioned higher than the liquid ejecting head, at least a portion of the air chamber may be positioned at a position lower than the filter.

According to such a configuration, when the apparatus is tuned over and is changed to the second posture from the first posture, the liquid that was upstream of the filter moves towards the air chamber through the plurality of flow paths coupled upstream of the filter in the supply flow path. Furthermore, since at least a portion of the air chamber is positioned at a position that is lower than that of the filter, the amount of liquid that moves to the air chamber is increased further.

When changed to the second posture, the liquid surface, which is an interface between the layer of air between the liquid storage portion and the filter and the liquid, can be made to overlap the filter or can be made to approach the upper surface of the filter. Accordingly, when in the second posture, the leaking of the liquid from the liquid ejecting head can be eliminated in a further reliable manner or, even if the liquid were to leak, the amount of leakage can be suppressed to a further small amount. Accordingly, leakage of the liquid from the liquid ejecting head can be suppressed.

(D) In the liquid ejecting apparatus described above, the supply flow path may include a filter chamber, the filter may be provided in the filter chamber, a ditch portion that is provided in the filter chamber, the ditch portion may be upstream from the filter, and the ditch portion may be at a position lower than an upstream surface of the filter when in the second posture, and at least one of the plurality of flow paths may be coupled to the ditch portion.

According to such a configuration, by having the liquid on the upstream surface of the filter flow to the low ditch portion around the filter, the liquid surface becomes flush with the upper surface of the filter or becomes lower than the upper surface of the filter, which facilitates formation of the meniscuses in the filter. Accordingly, when the posture of the liquid ejecting apparatus is changed from the first posture to the second posture, leaking of the liquid from the liquid ejecting head can be prevented.

(E) In the liquid ejecting apparatus described above, the air chamber may include a division wall that horizontally divides the air chamber when in the second posture.

According to such a configuration, when in the second posture and when the liquid ejecting apparatus is vibrated while being conveyed and the like in the second posture, movement of the liquid or the wave generated in the liquid is suppressed by having the liquid hit against the division wall horizontally dividing the air chamber. When, in the second posture, the liquid in the air chamber is bubbled, the volume of the liquid increases and the substantial amount of liquid accumulated in the air chamber becomes relatively small; accordingly, the liquid surface formed by the layer of air between the liquid storage portion and the filter rises above the anticipated height of the liquid surface. In such a case, inconveniences such as the meniscuses not being formed, and the amount of liquid leaking from the liquid ejecting head until the meniscuses are formed becoming large occur. However, since bubbling in the air chamber can be suppressed, the above inconvenience can be prevented to the utmost. Furthermore, bubbly liquid can be suppressed from entering the supply flow path.

(F) In the liquid ejecting apparatus described above, the division wall may be disposed at a position higher than a liquid surface in the air chamber when in the second posture.

According to such a configuration, when in the second posture B, there is little concern that the liquid that has moved to the air chamber below the division wall will return to upstream of the filter, and the volume at which the liquid covers the upper surface of the filter can be suppressed.

Note that when in the second posture, by having the volumetric capacity of the air chamber that is below the division wall and that is at a position lower than the position of the filter be larger than the volumetric capacity of the supply flow path upstream of the filter, the entire liquid upstream of the filter can be moved to the air chamber below the division wall. Accordingly, there are fewer incidents such as the liquid that has moved to the air chamber returning to the supply flow path upstream of the filter, and the liquid can be suppressed from covering the upper surface of the filter once again.

(G) In the liquid ejecting apparatus described above, the division wall may include a through hole that communicates two rooms with each other formed by dividing the air chamber with the division wall.

According to such a configuration, when in the second posture B, the liquid that has flowed into, among the two rooms that are the air chamber divided with the division wall, the upper room passes through the communication passage and moves to the room below the division wall; accordingly, the liquid can be collected in the lower portion of the air chamber.

(H) In the liquid ejecting apparatus described above, the air chamber may include a wall portion that protrudes in a direction intersecting the division wall.

According to such a configuration, a large movement of the liquid can be suppressed by dividing the rooms, which is the air chamber divided by the division wall, into small rooms with the wall portions and by hitting, against the wall portions, the wave generated in the liquid when the liquid ejecting apparatus is vibrated while being conveyed and the like. With the above, since a large wave is not generated in the liquid in the air chamber, bubbling of the liquid is suppressed. With the above, the frequency at which the meniscuses are not formed due to the liquid surface rising above the upstream surface of the filter, which is caused by the bubbling of the liquid in the air chamber, can be reduced, and the amount of liquid that leaks from the liquid ejecting head until the meniscuses are formed can be suppressed to a small amount. Furthermore, the bubbly liquid can be prevented from entering the supply flow path.

(I) In the liquid ejecting apparatus described above, at least a portion of the supply flow path upstream of the filter may pass a position lower than the filter when in the second posture According to such a configuration, when the liquid ejecting apparatus is in the second posture, the portion of the supply flow path between the liquid storage portion and the filter passes through a position that is lower than the filter; accordingly, the air upstream of the filter does not easily flow out towards the liquid storage portion side through the supply flow path.

What is claimed is:

1. A liquid ejecting apparatus comprising:
- a liquid ejecting head that ejects a liquid;
- a liquid storage portion that stores the liquid;
- a supply flow path that communicates the liquid ejecting head and the liquid storage portion with each other; and
- an air chamber that is coupled to the supply flow path through a plurality of flow paths, wherein
- the supply flow path includes a filter,
- the plurality of flow paths are, in the supply flow path, connected upstream from the filter, and
- the air chamber is positioned at a position higher than the filter when in a first posture that is a posture during use and in which the liquid ejecting head is positioned higher than the liquid storage portion.

2. The liquid ejecting apparatus according to claim 1, wherein when in the first posture, the plurality of flow paths are coupled to the supply flow path at a position higher than the filter.

3. The liquid ejecting apparatus according to claim 1, wherein when in a second posture that is a posture in which the liquid storage portion is positioned higher than the liquid ejecting head, at least a portion of the air chamber is positioned at a position lower than the filter.

4. The liquid ejecting apparatus according to claim 3, wherein
- the supply flow path includes a filter chamber,
- the filter is provided in the filter chamber,
- a ditch portion that is provided in the filter chamber, the ditch portion being upstream from the filter, and the ditch portion being at a position lower than an upstream surface of the filter when in the second posture, and
- at least one of the plurality of flow paths is coupled to the ditch portion.

5. The liquid ejecting apparatus according to claim 3, wherein the air chamber includes a division wall that horizontally divides the air chamber when in the second posture.

6. The liquid ejecting apparatus according to claim 5, wherein the division wall is disposed at a position higher than a liquid surface in the air chamber when in the second posture.

7. The liquid ejecting apparatus according to claim 5, wherein the division wall includes a through hole that communicates two rooms with each other formed by dividing the air chamber with the division wall.

8. The liquid ejecting apparatus according to claim 5, wherein the air chamber includes a wall portion that protrudes in a direction intersecting the division wall.

9. The liquid ejecting apparatus according to claim 3, wherein at least a portion of the supply flow path upstream of the filter passes a position lower than the filter when in the second posture.

10. The liquid ejecting apparatus according to claim 1, wherein the plurality of flow paths are provided separately from the supply flow path.

11. A liquid ejecting apparatus comprising:

a liquid ejecting head that ejects a liquid;

a liquid storage portion that stores the liquid;

a supply flow path that communicates the liquid ejecting head and the liquid storage portion with each other; and an air chamber that is coupled to the supply flow path through a plurality of flow paths, wherein the supply flow path includes a filter, the plurality of flow paths are, in the supply flow path, connected upstream from the filter, and the air chamber is positioned at a position higher than the filter when in a first posture that is a posture during use, and when in a second posture that is a posture in which the liquid storage portion is positioned higher than the liquid ejecting head, at least a portion of the air chamber is positioned at a position lower than the filter.

* * * * *